US008341985B2

(12) United States Patent
Ezzo et al.

(10) Patent No.: US 8,341,985 B2
(45) Date of Patent: Jan. 1, 2013

(54) SECURITY DEVICE FOR RING PRODUCTS

(75) Inventors: Mark Ezzo, Tyler, TX (US); Matthew R. Shute, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 13/285,400

(22) Filed: Oct. 31, 2011

(65) Prior Publication Data

US 2012/0042702 A1 Feb. 23, 2012

Related U.S. Application Data

(63) Continuation of application No. 13/072,424, filed on Mar. 25, 2011.

(60) Provisional application No. 61/347,679, filed on May 24, 2010, provisional application No. 61/378,312, filed on Aug. 30, 2010.

(51) Int. Cl.
*E05B 73/00* (2006.01)

(52) U.S. Cl. ..... 70/57.1; 70/57; 70/58; 70/62

(58) Field of Classification Search ..... 70/57.1, 70/57, 62, 58
See application file for complete search history.

(56) References Cited

U.S. PATENT DOCUMENTS

| | | | | |
|---|---|---|---|---|
| 3,260,079 | A * | 7/1966 | Caskey | 70/25 |
| 4,866,958 | A * | 9/1989 | Bretl et al. | 70/25 |
| 4,866,959 | A * | 9/1989 | Ling | 70/25 |
| 4,952,228 | A * | 8/1990 | Taylor et al. | 70/25 |
| 4,970,881 | A * | 11/1990 | Hsiao | 70/25 |
| 5,421,177 | A * | 6/1995 | Sieber et al. | 70/57.1 |
| 5,437,172 | A * | 8/1995 | Lamy et al. | 70/57.1 |
| 5,767,773 | A * | 6/1998 | Fujiuchi et al. | 340/571 |
| 5,856,782 | A * | 1/1999 | Sasagawa et al. | 340/572.9 |
| 5,864,290 | A * | 1/1999 | Toyomi et al. | 340/572.9 |

(Continued)

FOREIGN PATENT DOCUMENTS

GB 2 305 212 A 4/1997

(Continued)

OTHER PUBLICATIONS

Invitation to Pay Additional Fees and International Search Report for International Application No. PCT/US2011/034871, mailed Sep. 28, 2011. International Search Report and Written Opinion for International Application No. PCT/US2011/034871, mailed Feb. 27, 2012.

*Primary Examiner* — Suzanne Barrett
*Assistant Examiner* — Ifeolu Adeboyejo
(74) *Attorney, Agent, or Firm* — Alston & Bird LLP

(57) ABSTRACT

Various embodiments of a security device are provided for attaching to and securing small articles, such as jewelry or other accessories that are either loose or attached to a display card. The security device may engage various sizes of card stock and/or secure articles that include a ring component in a practical and unobtrusive manner. The security device may detect unauthorized removal of the item from the retail premises. In some cases, the security device may also be configured to detect tampering of the security device and may include one-alarm, two-alarm, or three-alarm functionality. Moreover, the security device may also provide other features or functionalities that a retail operator may prefer or consider prior to the use or selection of a particular security device over others. The device may provide easy securing to and/or removal from an object by an authorized operator, such as an employee, and may be reusable.

23 Claims, 30 Drawing Sheets

U.S. PATENT DOCUMENTS

| | | | | |
|---|---|---|---|---|
| 6,212,920 | B1 * | 4/2001 | Winner | 70/38 C |
| 7,403,118 | B2 * | 7/2008 | Belden, Jr. | 340/568.2 |
| 7,703,308 | B2 * | 4/2010 | Nagelski | 70/57.1 |
| 2003/0116632 | A1 | 6/2003 | Zimmerman et al. | |
| 2009/0102666 | A1 * | 4/2009 | Shute et al. | 340/572.9 |

FOREIGN PATENT DOCUMENTS

| | | | |
|---|---|---|---|
| GB | 2305212 | A * | 4/1997 |
| WO | WO 98/40591 | A1 | 9/1998 |
| WO | WO 2008/088681 | A1 | 7/2008 |

* cited by examiner

SECURITY DEVICE FOR RING PRODUCTS

CROSS-REFERENCE TO RELATED APPLICATIONS

This application is a continuation of U.S. non-provisional patent application Ser. No. 13/072,424, new published as U.S. Patent Application Publication No. US 2011-0283754, filed on Mar. 25, 2011, for "Security Device for Ring Products," which claims the benefit of U.S. Provisional Application No. 61/347,679, filed on May 24, 2010, and also claims the benefit of U.S. Provisional Application No. 61/378,312, filed on Aug. 30, 2010, the contents of each of which are incorporated herein by reference in their entirety.

FIELD OF THE INVENTION

The present invention relates to security devices used to protect merchandise or other objects and, more particularly, to security devices used to protect products having a relatively small ring structure or component, such as rings, bracelets, necklaces, and other jewelry.

BACKGROUND

Electronic article surveillance (EAS) systems are often used to deter and detect shoplifting. Typically, an EAS security system includes an EAS element, a transmitter, a receiver, and an alarm. The EAS element is attached to an article of merchandise. The transmitter and the receiver are positioned at the exit of a retail establishment and configured to establish a detection zone through which a consumer must pass as he or she exits the retail establishment. The transmitter is configured to send signals through the detection zone. When an EAS element enters the detection zone, the EAS element responds and creates a signal or a change or disturbance in the original signal transmitted by the transmitter, which is detectable by the receiver. Upon detection of the EAS element, the alarm is triggered in order to notify store personnel that someone is trying to exit the retail establishment with merchandise that has an attached and active EAS element.

Often, security devices are not used for jewelry items that are below a certain value and are displayed on racks or shelves (i.e., not kept in a locked display enclosure). Although each such item may not necessarily be expensive, the theft of these items in the aggregate costs merchants hundreds of thousands of dollars.

Applicant has discovered then that it would be desirable to provide devices and methods of reliably securing an EAS element to small items including articles of jewelry in a simple, cost-effective, and aesthetically pleasing manner. As described in greater detail below, a variety of challenges were identified and overcome through Applicant's efforts to invent and develop such a device.

BRIEF SUMMARY

Accordingly, various embodiments of security devices are provided for securing items. In one embodiment, a security device for securing an item having a display card supporting a ring-shaped component is provided. The security device may include a main body defining a gap configured to receive and hold the display card, a locking assembly supported by the main body, and a capture member defining an anchor end and a receiving end. The anchor end may be affixed to the main body, and the receiving end may be configured to be passed through the ring-shaped component. Furthermore, the receiving end may be movable between a capture position, in which the receiving end is engaged with the locking assembly, and an open position, in which the receiving end is disengaged from the locking assembly. The locking assembly may be configurable between a locked state, in which, the locking assembly engages the receiving end of the capture member to retain the receiving end in the capture position, and an unlocked state, in which the locking assembly is disengaged from the receiving end of the capture member to facilitate movement of the receiving end to the open position.

In some cases, the display card may be held within the gap via a press fit between the display card and the main body. The main body may define a cavity configured to receive a hang tab of the display card, and in some cases the main body may define a cut out portion configured to allow access to a hole defined in the display card such that the display card may be hung on a pronged display via the hole while secured by the security device. The security device may further comprise an extrusion supported by the main body and configured to engage a notched display rack for displaying the article while secured by the security device. The main body may define a viewing area configured to allow at least a portion of the display card to be viewed by a consumer.

In addition, the security device may further comprise an alarm housing supported by the main body. The alarm housing may be integral to the main body and may further include a security element disposed within the alarm housing. In some cases, at least one of the anchor end and the receiving end of the capture member may comprise a ferrule. Furthermore, the capture member may comprise a flexible cable.

In some embodiments, the capture member may comprise a locking clip having a capture member-receiving portion and a pin-receiving portion. The capture member-receiving portion may be configured to be fixedly attached to the receiving end of the capture member. The locking assembly may comprise a locking pin having a shaft and a head, wherein the shaft defines a longitudinal axis and is configured to engage the pin-receiving portion of the locking clip, and wherein the head defines a cavity. The locking assembly may further comprise a locking disk defining a void that is substantially aligned with the pin-receiving portion of the locking clip, wherein the void is configured to receive the shaft therethrough, and a locking spring defining a first end and a second end, wherein the cavity defined by the head of the locking pin is configured to receive the first end of the locking spring. The locking assembly may also include a cover attached to the main body of the security device, wherein the second end of the locking spring is configured to engage an inner surface of the cover. The locking disk may be circumferentially attached to the inner surface of the cover such that the locking disk limits movement of the locking pin in a direction other than along the longitudinal axis of the shaft. Thus, in the locked state, the locking spring may exert a force upon the head of the locking pin and, when the capture member is in the capture position, the locking pin may maintain engagement of the shaft of the locking pin with the pin-receiving portion of the locking clip to secure the capture member within the locking assembly.

In some cases, at least a portion of the locking pin may comprise a magnetic material, and an outer surface of the cover may define a key engaging portion such that application of a magnetic key proximate the key-engaging portion serves to disengage the shaft of the locking pin from the pin-receiving portion of the locking clip, thereby allowing the capture member to be moved from the capture position to the open position. In addition, the pin-receiving portion of the locking clip may define an opening configured to receive at least a portion of the shaft of the locking pin, and the main body of the security device may define a recess that is substantially aligned with the opening and is configured to receive an end of the shaft therein.

The main body may comprise a first plate and a second plate disposed opposite the first plate. The alarm housing may be disposed on the first plate, and the locking assembly may be disposed in a locking area defined by the first plate. The locking area may be defined by protrusions extending from a surface of the first plate. Furthermore, the main body may comprise a display portion and an obscured portion disposed opposite the display portion, and the gap may be defined between the display portion and the obscured portion. The lock housing may extend from the obscured portion in a direction away from the display portion. In addition, the security device may further comprise an extrusion extending from the obscured portion and configured to engage a notched display rack for displaying the article while secured by the security device, wherein the lock housing is at least partially disposed between the extrusion and the gap.

In some embodiments, the security device may further comprise an alarm housing supported by the main body. The anchor end of the capture member may be affixed proximate the alarm housing, and the display portion may define an access port configured to provide access for the receiving end of the capture member to engage the locking assembly.

The receiving end of the capture member may comprise a tip and define a recess, and the locking assembly may comprise a locking member configured to engage the recess and a biasing element configured to bias the locking member into engagement with the recess in the capture position so as to secure the capture member within the locking assembly. At least a portion of the locking member may comprise a magnetic material, and the main body of the security device may be configured to engage a magnetic key such that, when the magnetic key is applied, the locking member is disengaged from the recess and the capture member is movable from the capture position to the open position. Furthermore, the capture member may be configured to engage and secure the ring-shaped component, and the main body may be configured to engage and secure the display card via the gap.

In other embodiments, a locking assembly for a security device configured for securing items may be provided. The locking assembly may comprise a locking pin comprising at least one locking arm, wherein the locking arm defines at least one locking extension, and a lock housing. The lock housing may define an exterior wall, an interior wall that defines at least one locking feature, at least one channel disposed between the exterior wall and the interior wall configured to receive the least one locking arm of the locking pin, an interior cavity, a pin-receiving opening in communication with the at least one channel, and a key-receiving opening in communication with the interior cavity and disposed opposite the pin-receiving opening. At least one channel may be configured to receive at least one locking arm via the pin-receiving opening such that a surface of the at least one locking extension engages the at least one locking feature to secure the locking pin within the lock housing in a capture position. Furthermore, the interior cavity may be configured to receive a key via the key-receiving opening such that rotation of the key within the interior cavity may serve to move the at least one locking extension out of engagement with the at least one locking feature so that the locking pin is movable from the capture position to an open position.

In some cases, each locking feature of the lock housing may comprise at least one notch configured to engage the locking extensions of the locking pin, and each notch may extend between one of the channels and the interior cavity. At least a portion of each locking extension of the at least one locking arm may be tapered such that movement of the locking arms past the at least one locking feature urges the locking arms away from each other to clear the at least one locking feature when the locking pin is moved from the open position to the capture position. In addition, the lock housing may be configured to receive a key that includes a shaft and a body, and the shaft may define at least one cam feature. The number of cam features may correspond to the number of locking extensions of the locking pin, and each cam feature may be disposed at a location corresponding to a location of one of the locking extensions such that, when the key is inserted into the interior cavity of the lock housing and is rotated, the cam features engage the corresponding locking extensions and move the locking arms so as to disengage each locking extension from the corresponding locking feature.

The lock housing may be configured to receive the key within the interior cavity in a predetermined orientation via the key-receiving end. The key may define a surface configured to engage the key-receiving opening of the lock housing. In addition, the security device may further comprise an alarm housing, wherein the lock housing is fixedly attached to the alarm housing. For example, the lock housing may be integrally formed with the alarm housing.

In some cases, the security device may further comprise a security element disposed within the alarm housing. In the open position, the locking pin may be capable of being passed through a ring-shaped component for securing an item supporting the ring-shaped component. In addition, the lock housing may be cylindrical.

In still other embodiments, a security device for securing an item comprising a ring shape may be provided. The security device may comprise a housing, a sliding member at least partially disposed within the housing and configured to move between a capture position and an open position, and a capture member defining an anchor end and a receiving end. The anchor end may be affixed to the sliding member, and the receiving end may be configured to receive the item when the sliding member is in the open position and may be configured to be received within the housing to secure the item to the security device when the sliding member is in the capture position. The security device may further comprise a locking assembly disposed within the housing configured to engage the sliding member to limit the movement of the sliding member. The locking assembly may be configurable between a locked state, in which the locking assembly engages the sliding member to retain the sliding member in the capture position, and an unlocked state, in which the locking assembly is disengaged from the sliding member to facilitate movement of the sliding member to the open position.

In some cases, the locking assembly may comprise a retention member and a biasing element. The retention member may define an engagement portion configured to engage the sliding member and a shaft portion configured to be received by the biasing element. The biasing element may be configured to bias the retention member toward engagement with the sliding member to maintain the sliding member in the capture position. At least a portion of the retention member may be magnetic, and application of a magnetic key at a predetermined location on a surface of the housing may serve to move the retention member out of engagement with the sliding member.

In addition, the sliding member may be configured to move between the capture position and the open position along a first axis, and the retention member may be configured to move into and out of engagement with the sliding member along a second axis, wherein the second axis is substantially perpendicular to the first axis. The engagement portion of the retention member may comprise a main portion and end portions, and each end portion may extend substantially perpendicularly from the main portion in a direction away from the shaft portion. The engagement portion of the retention member may define an engagement surface configured to engage a corresponding surface of the sliding member. The corresponding surface of the sliding member may be defined at an end of the sliding member.

In some cases, the housing may define a slot, and the sliding member may define an actuation portion accessible via the slot and configured to allow a user to move the sliding member between the capture position and the open position when the security device is in the unlocked state. Furthermore, the sliding member may define an internal surface, and the internal surface may define an anchor portion configured to receive and secure the anchor end of the capture member. The capture member may define a fixed portion proximate the anchor end and a hook portion proximate the receiving end, and the hook portion may have a "U" shape. In addition, the hook portion may extend substantially perpendicularly from the fixed portion. In some cases, the capture member may comprise hardened steel wire. Also, in some embodiments, the security device may further comprise a security element disposed within the housing.

BRIEF DESCRIPTION OF THE SEVERAL VIEWS OF THE DRAWING(S)

Reference will now be made to the accompanying drawings, which are not necessarily drawn to scale, and wherein.

Figure 12:
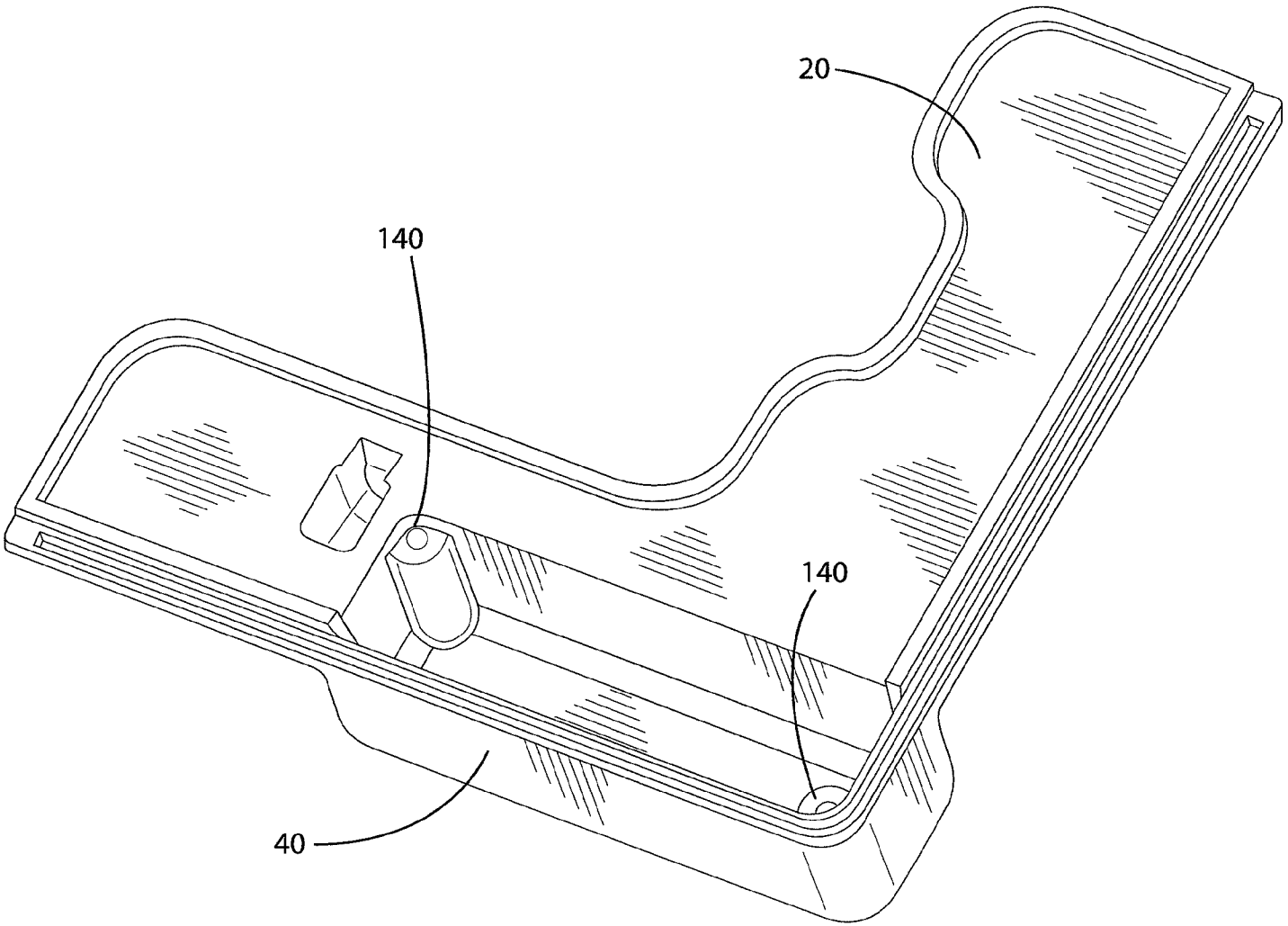
Figure 13:
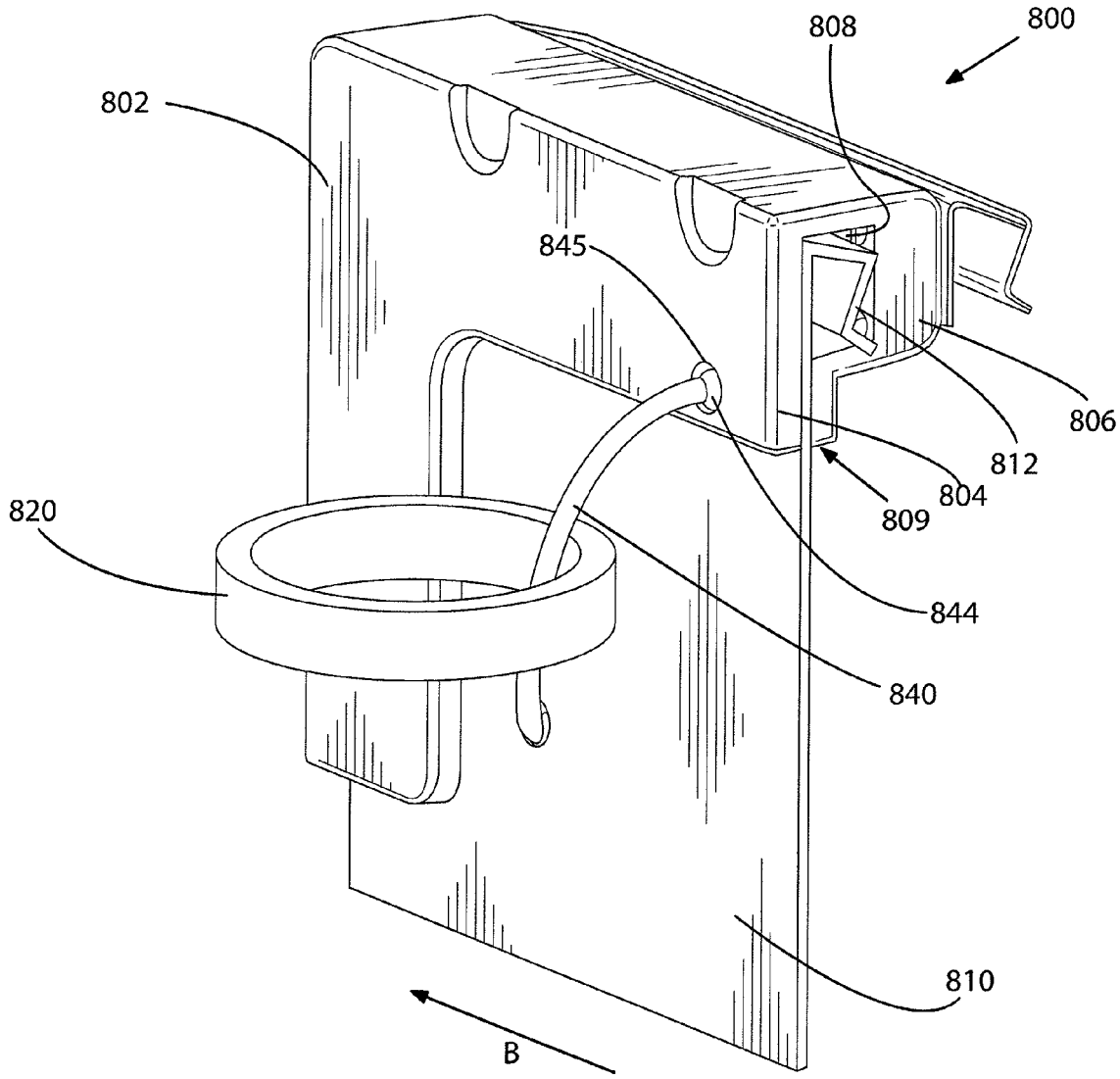
Figure 14:
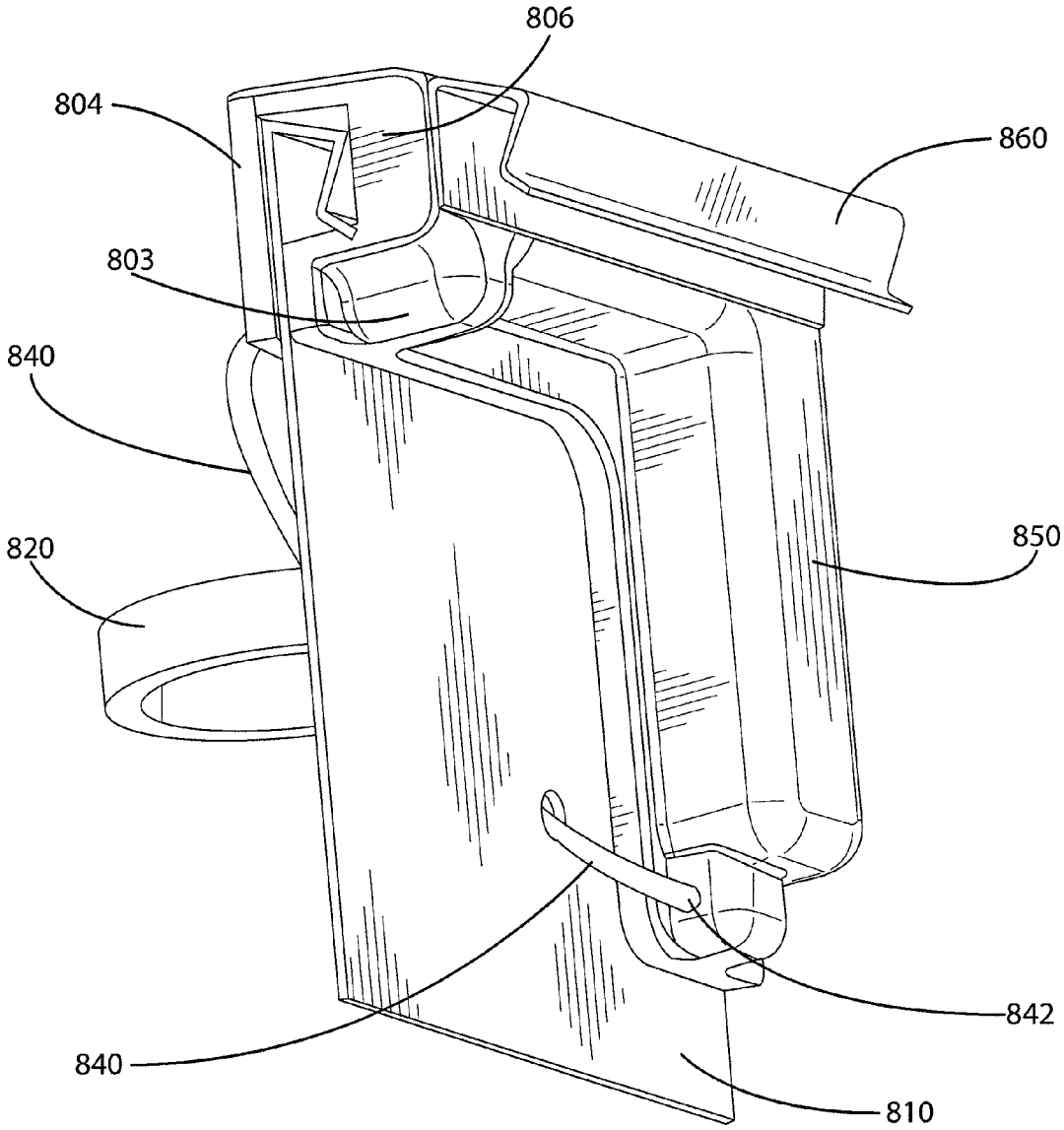
Figure 15:
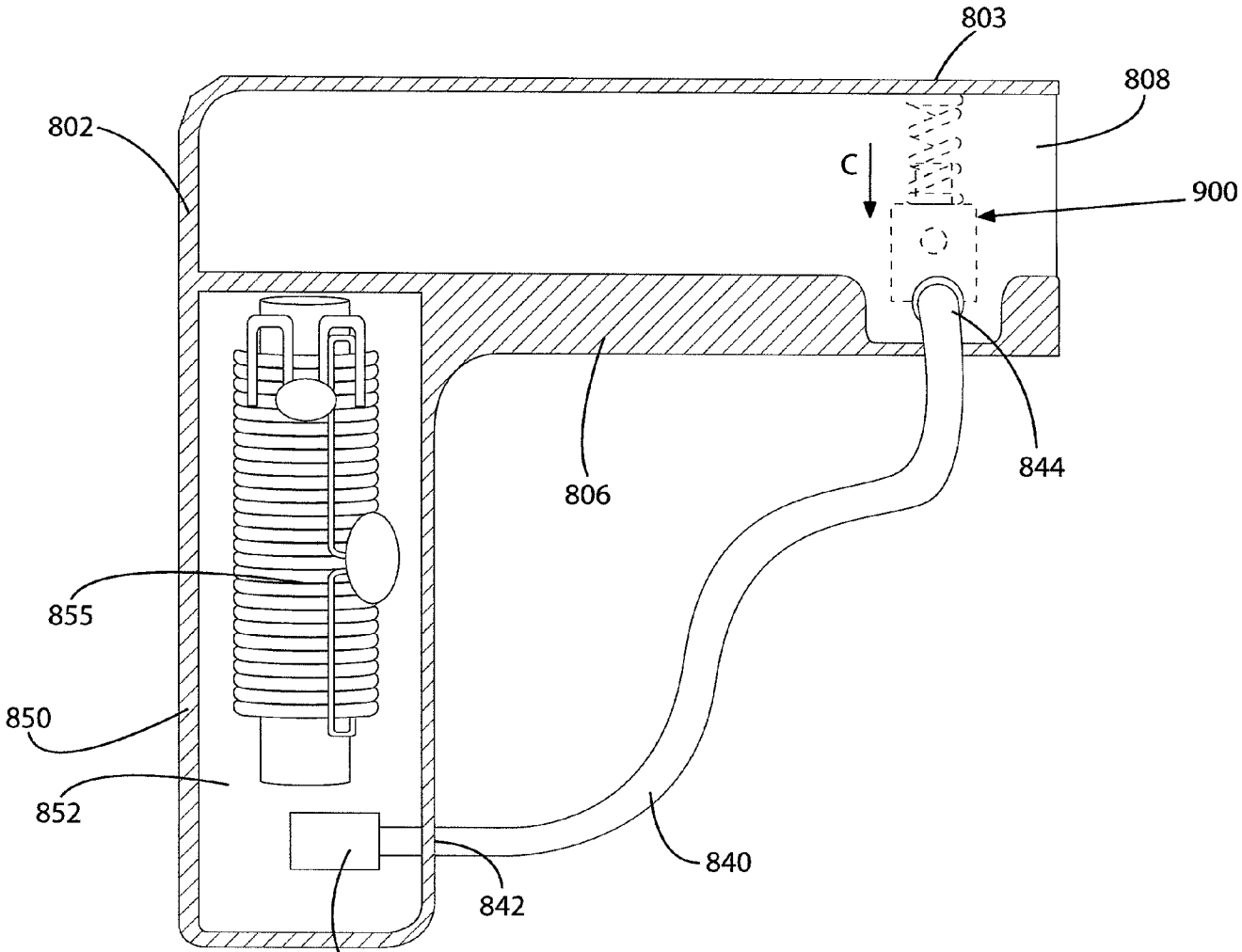
Figure 16:
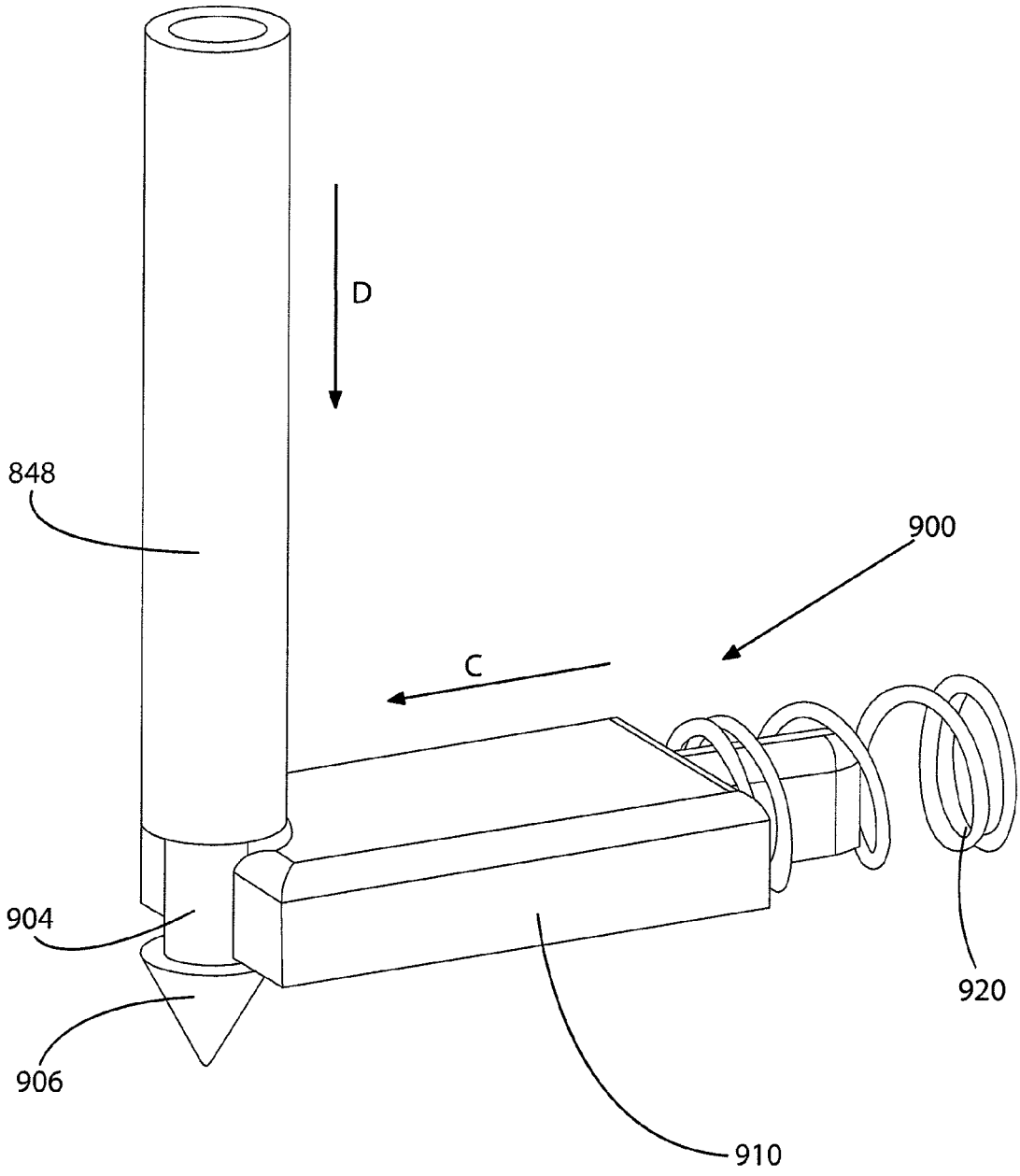
Figure 17:
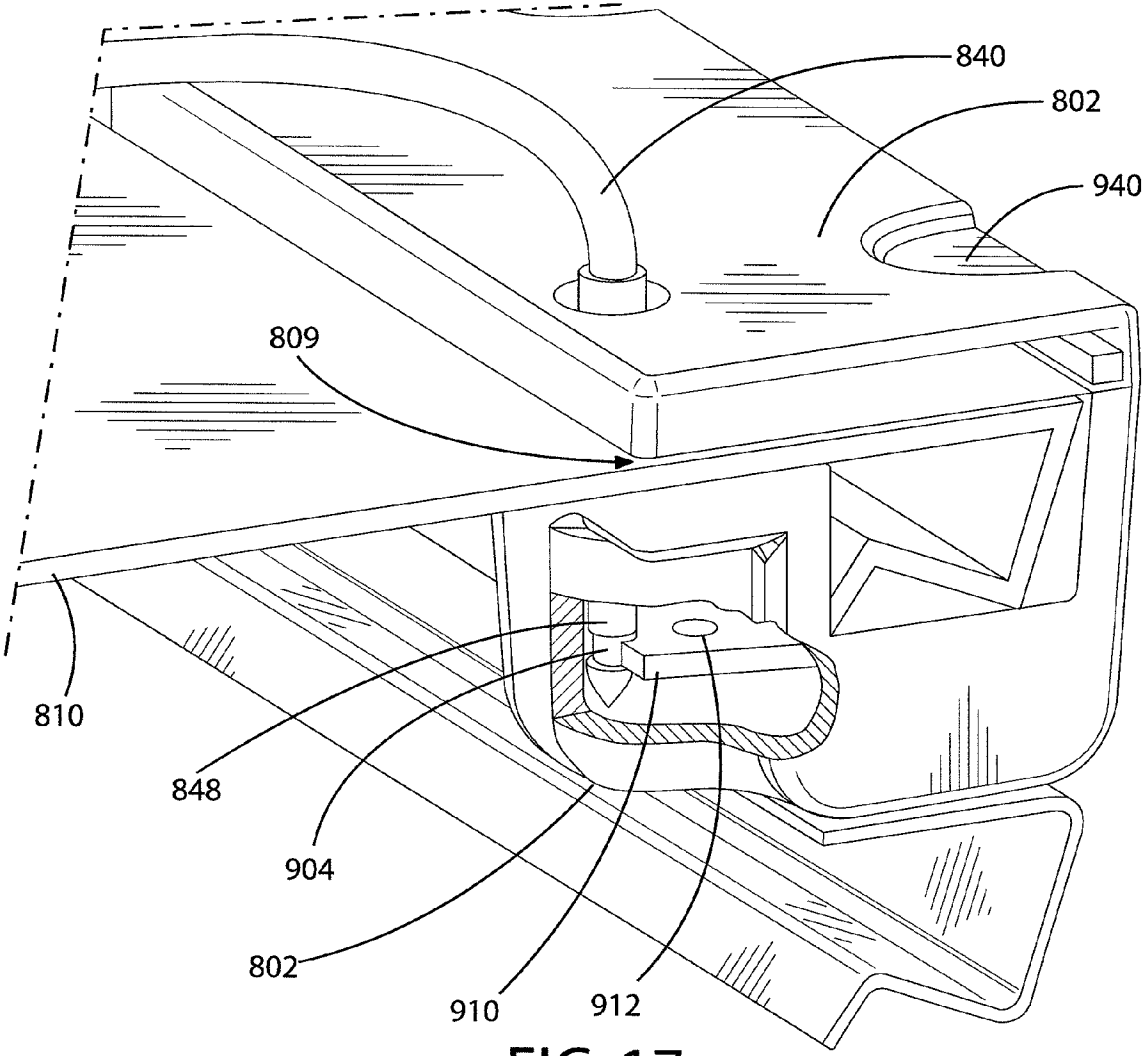
Figure 18B:
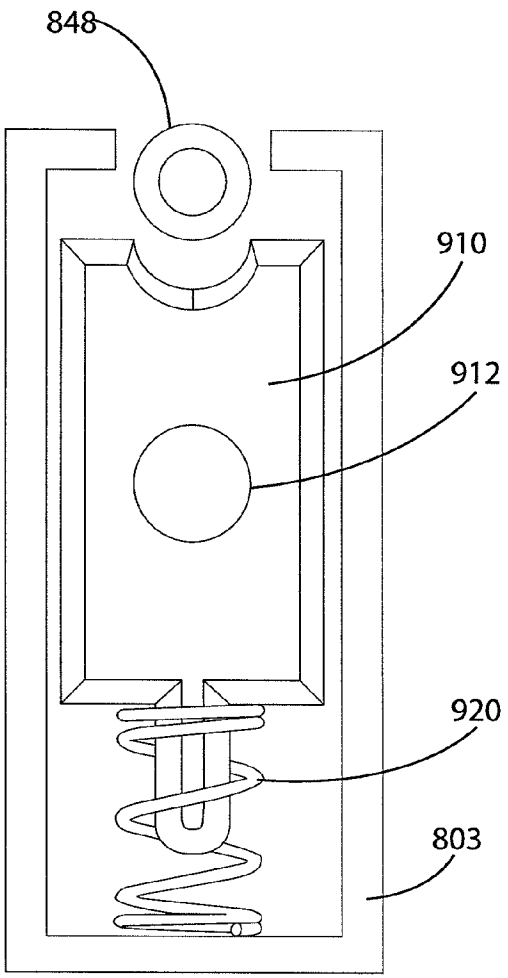
Figure 18A:
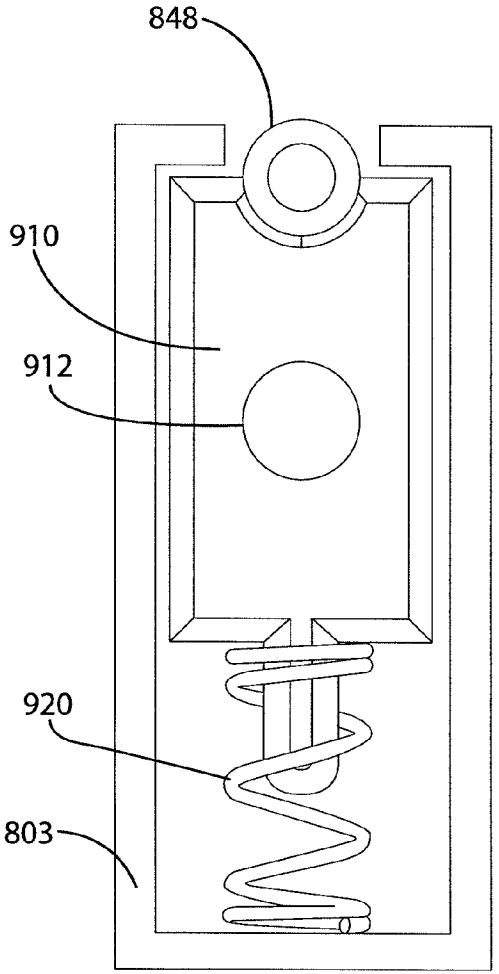
Figure 19:
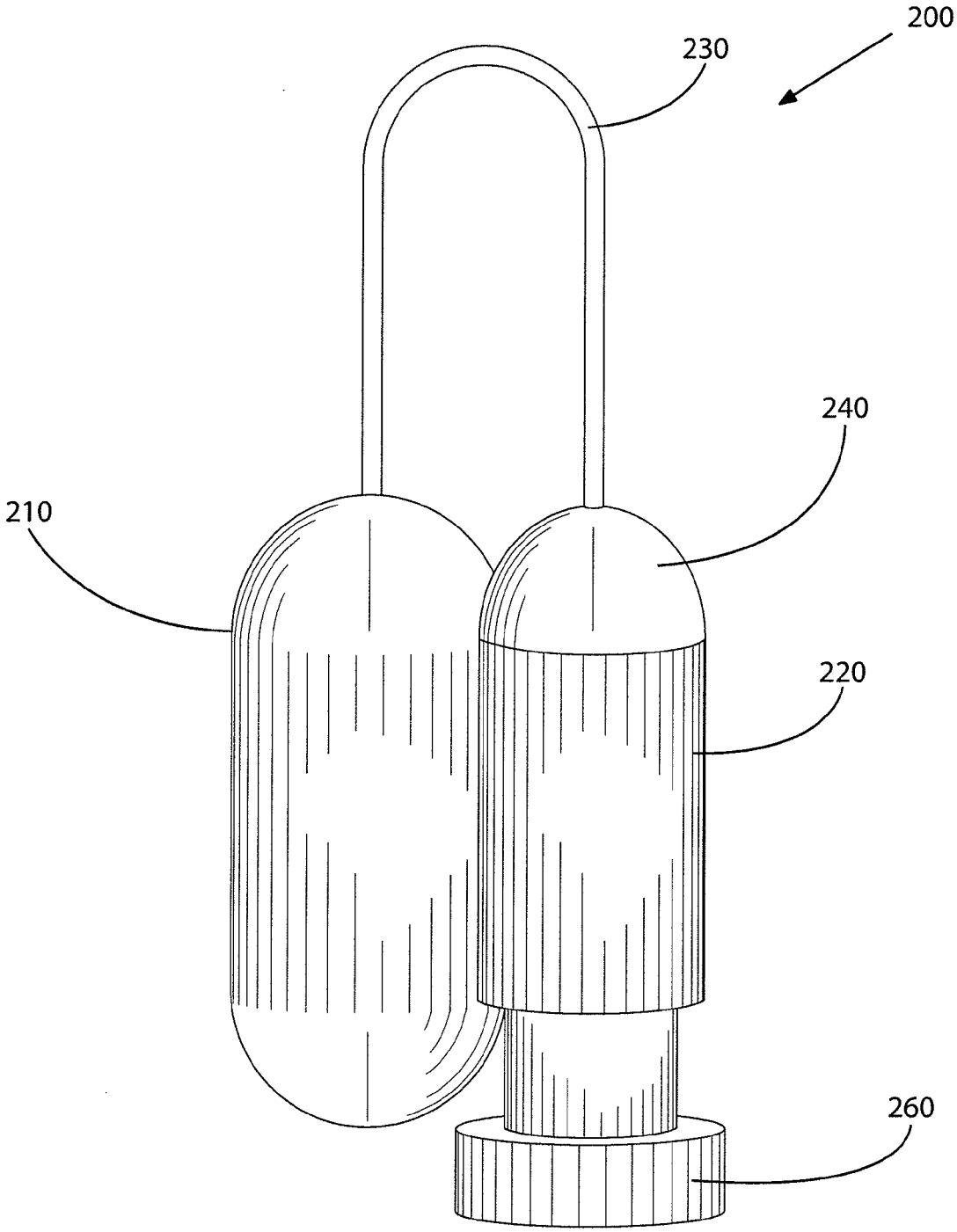
Figure 20:
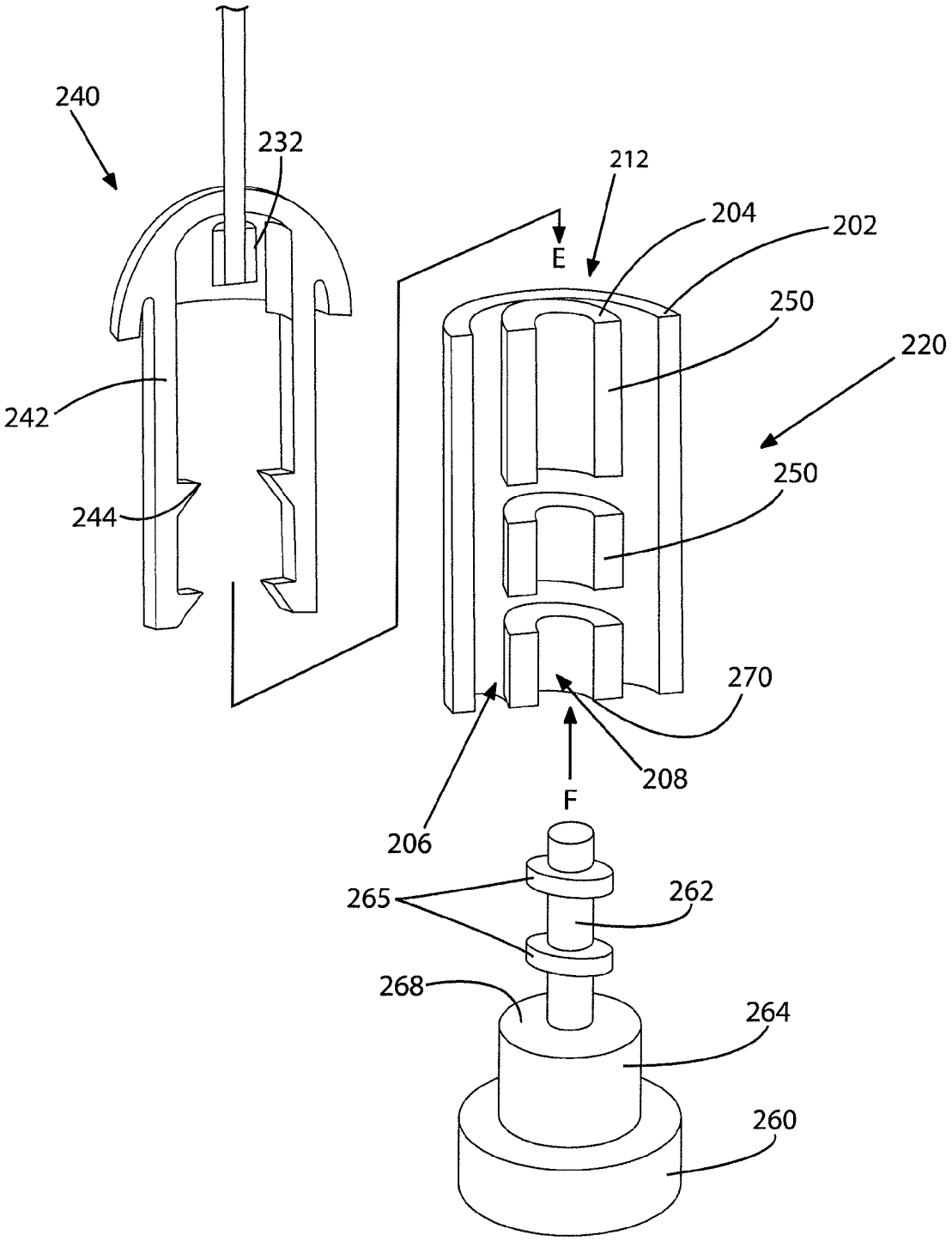
Figure 21:
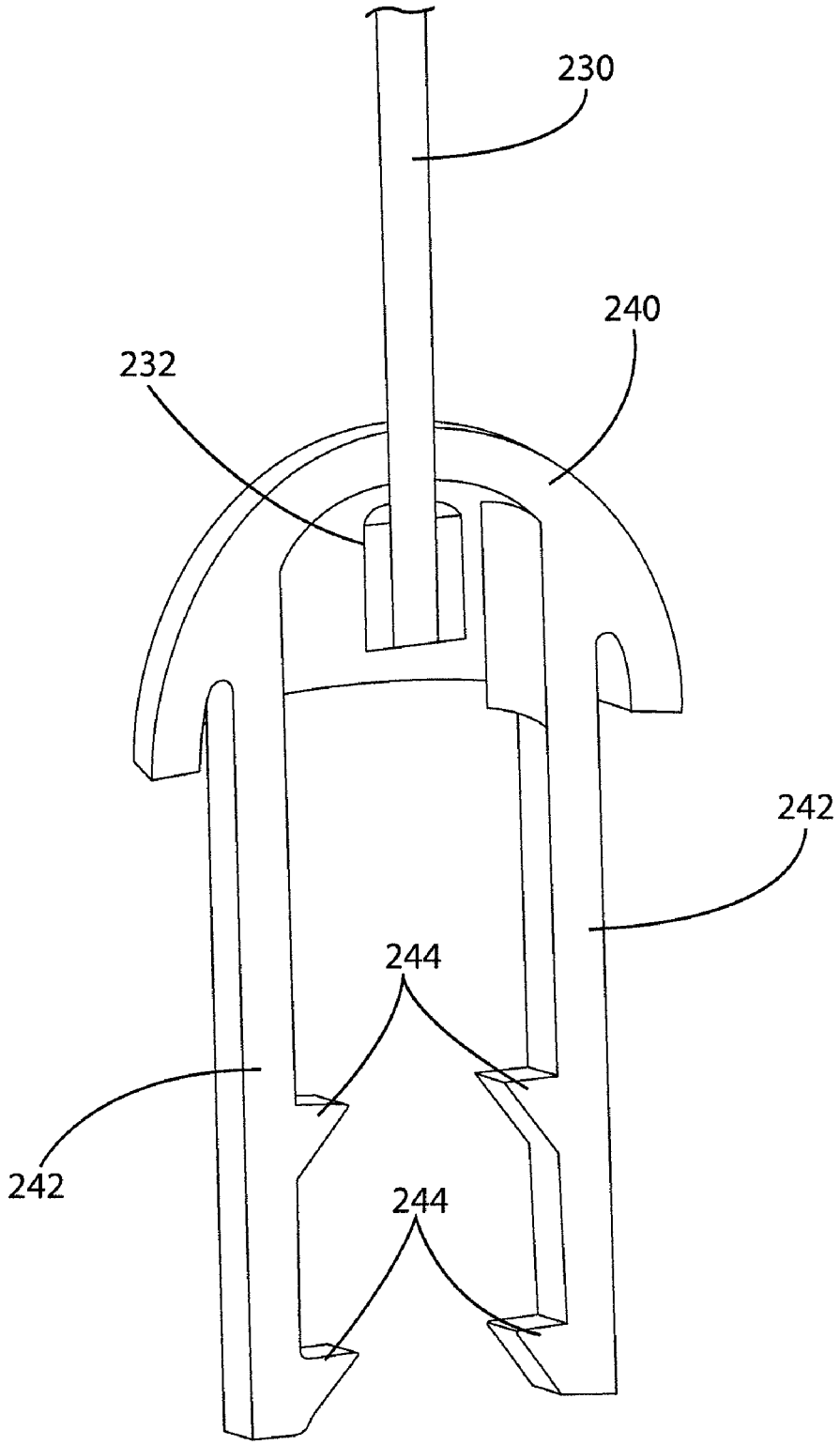
Figure 22:
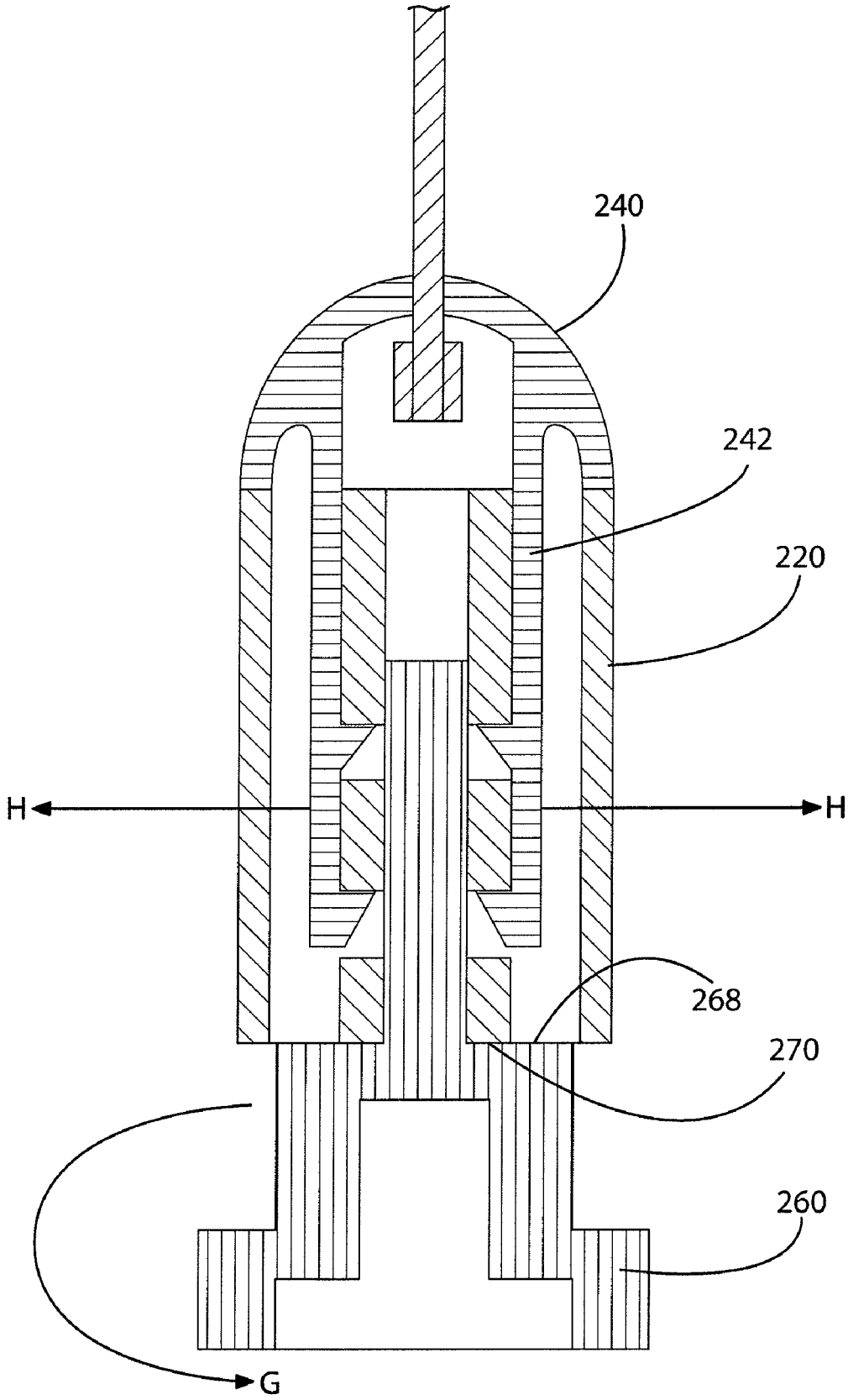
Figure 24:
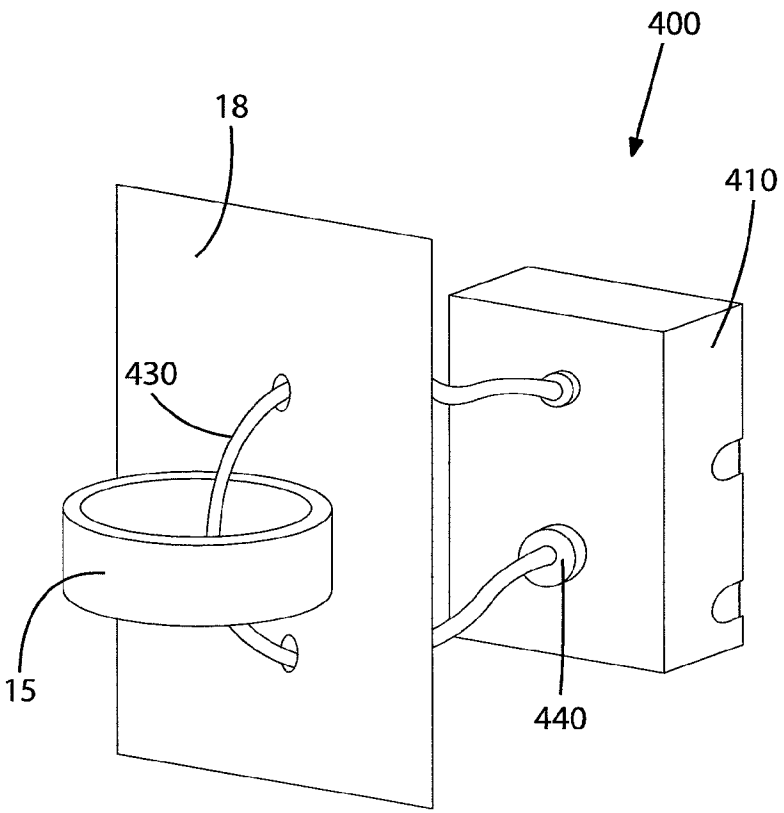
Figure 23:
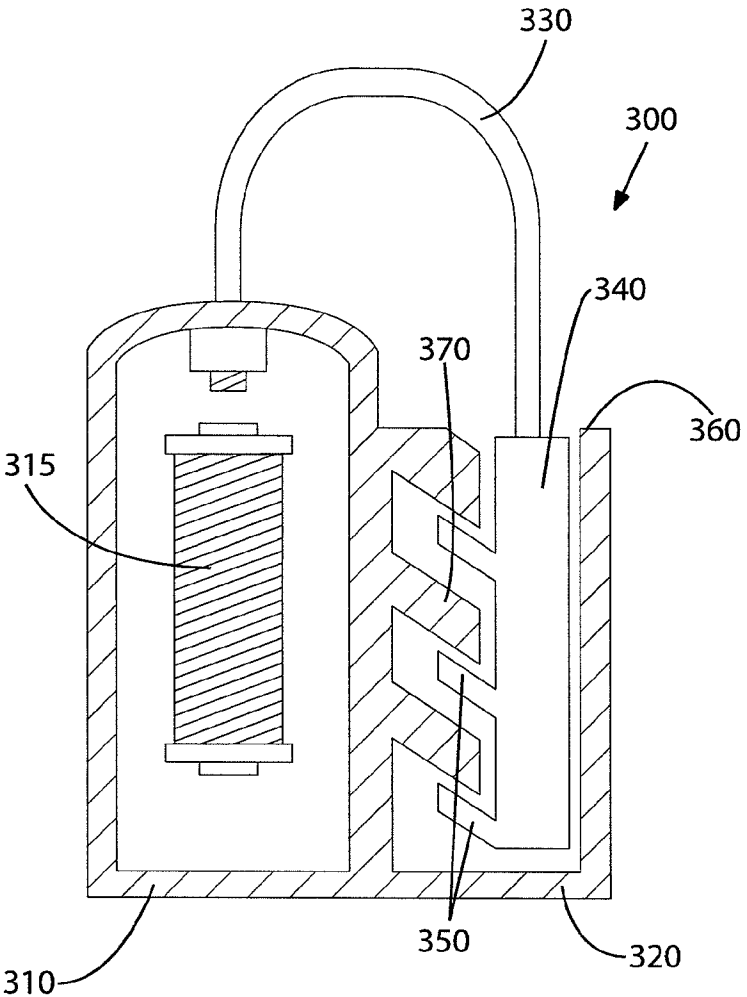
Figure 26:
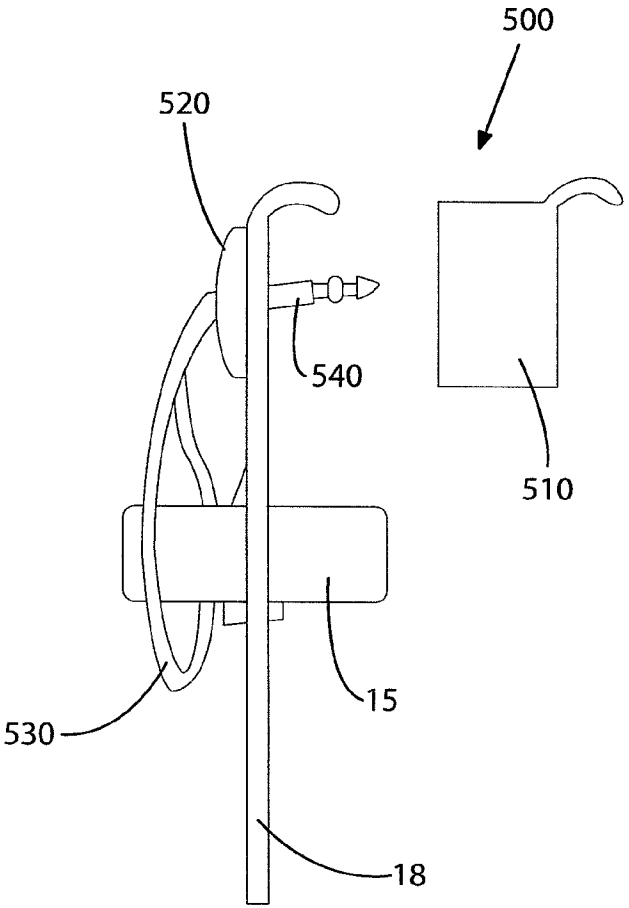
Figure 25:
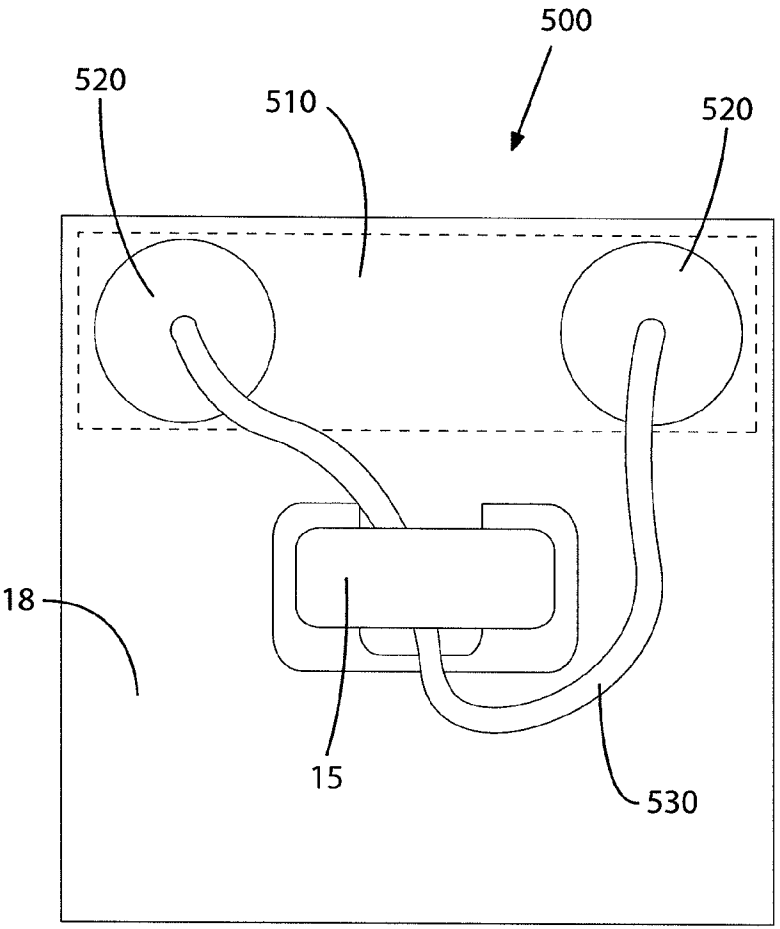
Figure 28:
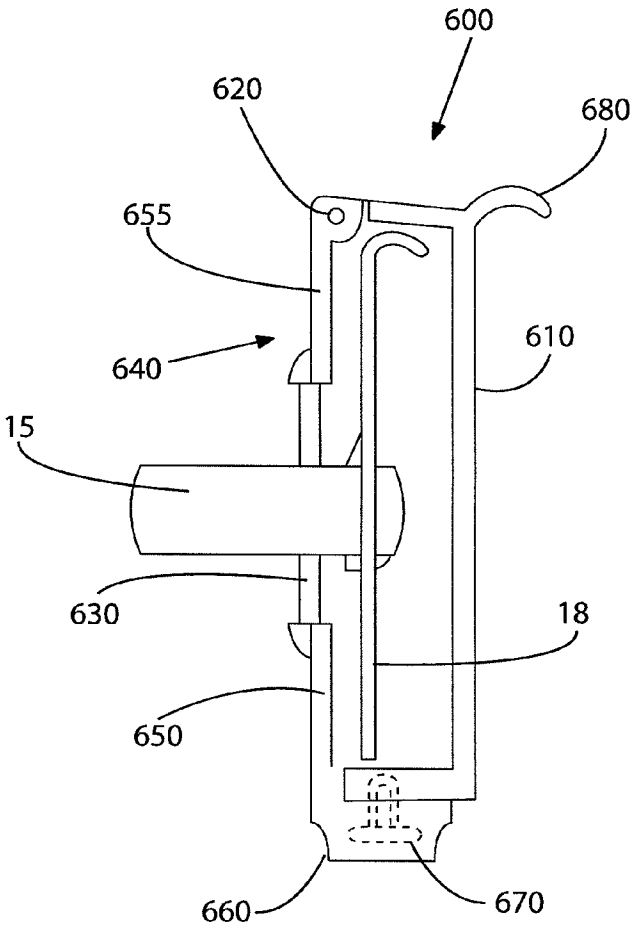
Figure 27:
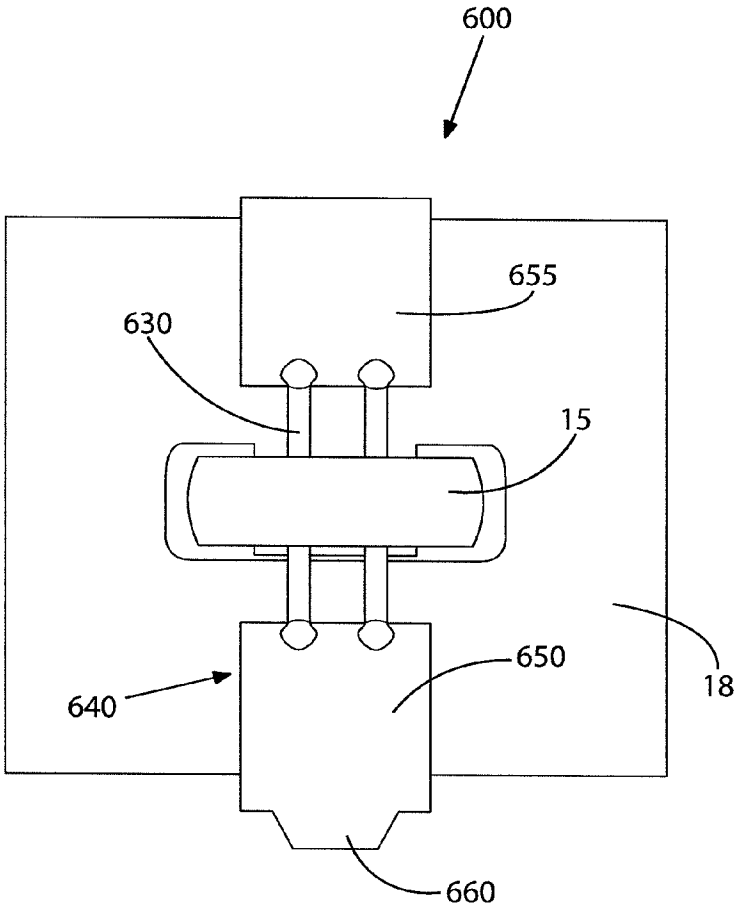
Figure 29:
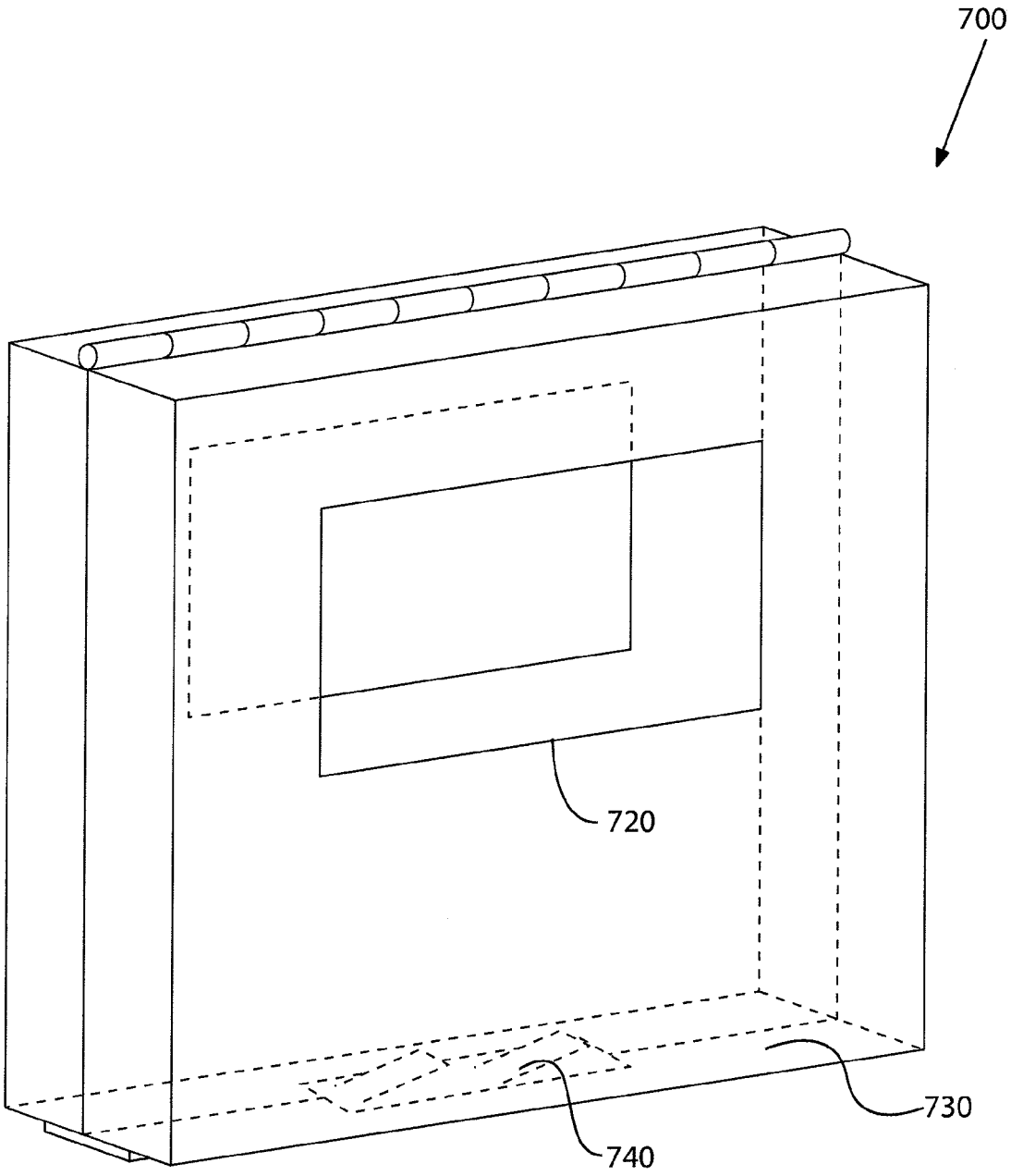
Figure 30:
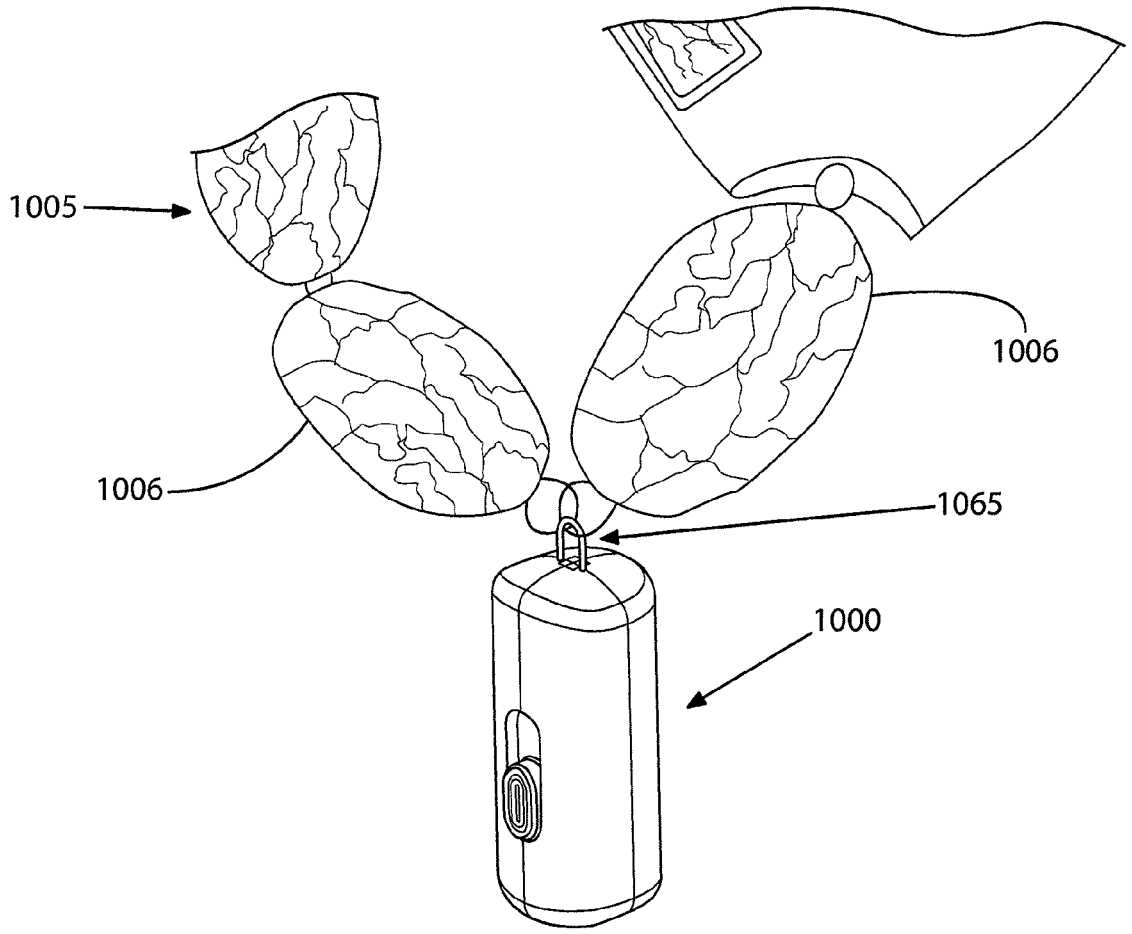
Figure 31:
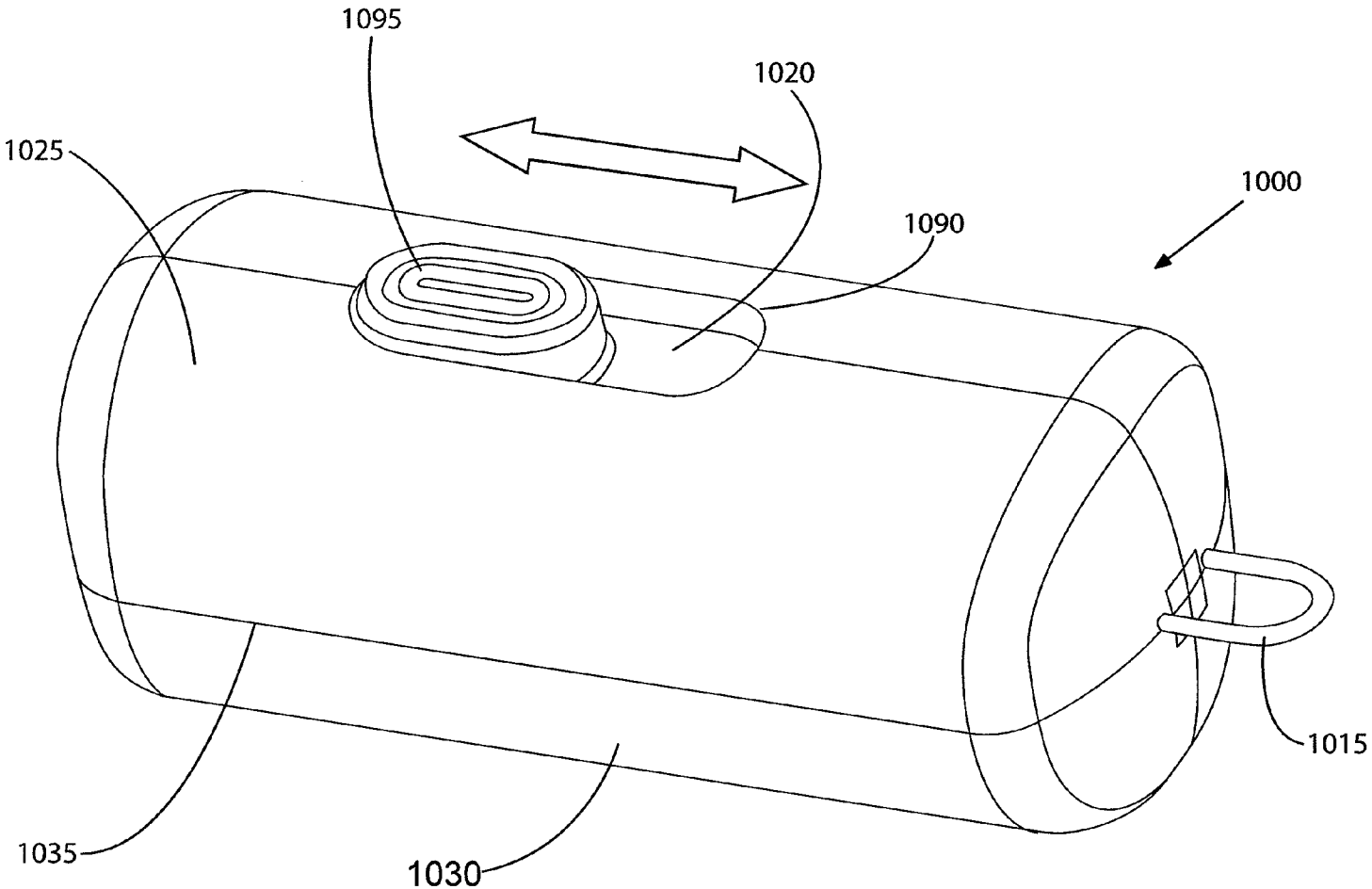
Figure 32:
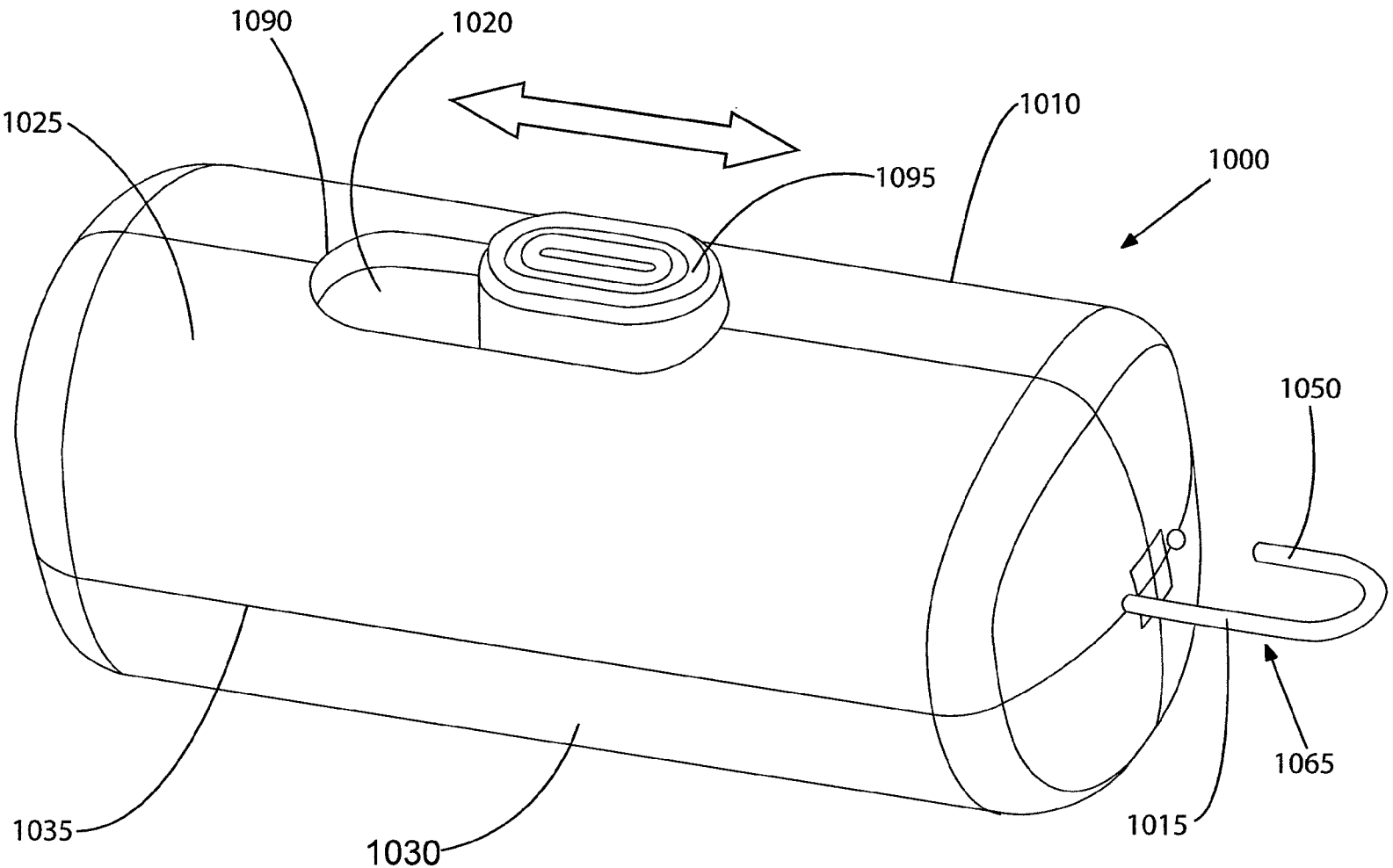
Figure 33:
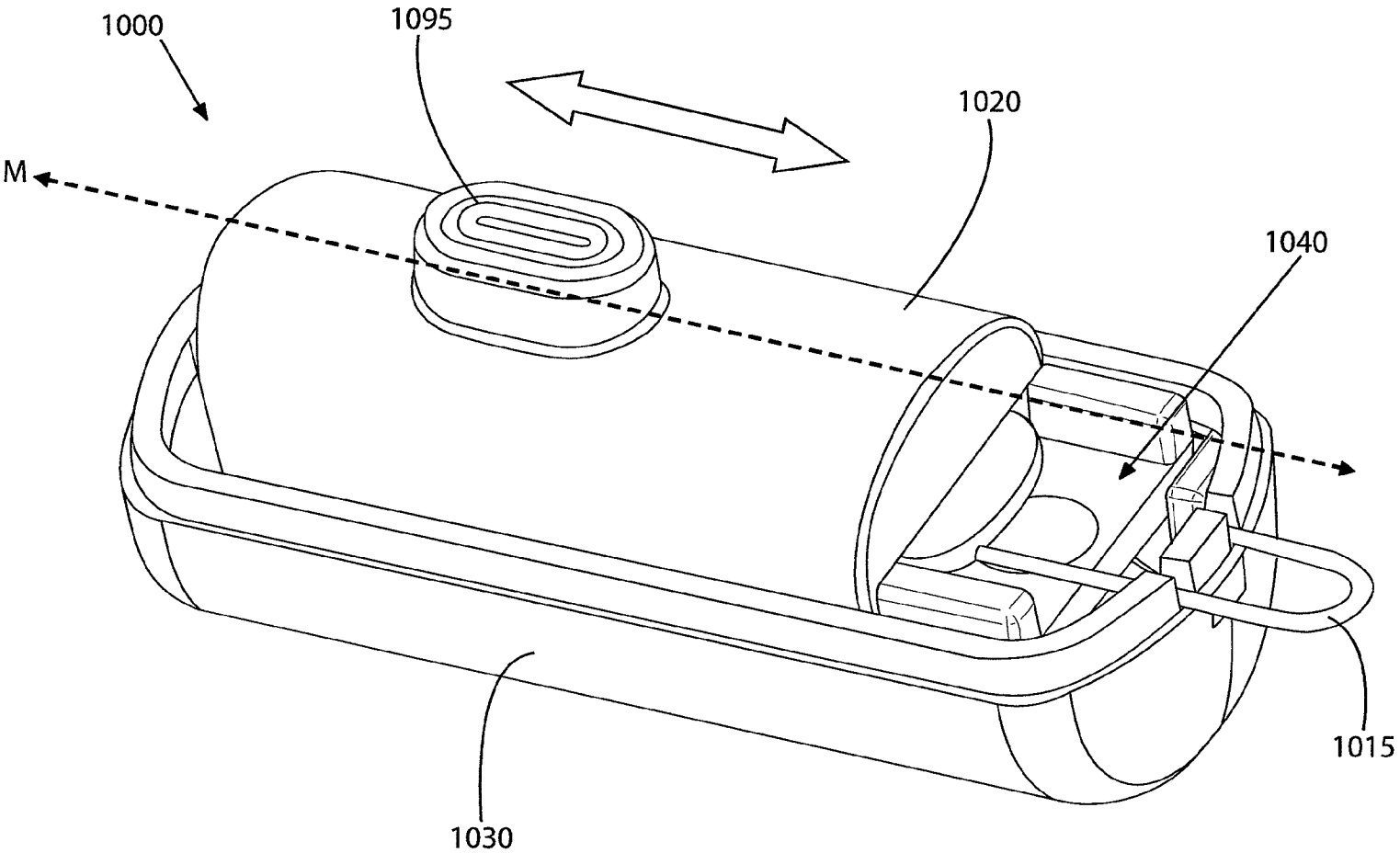
Figure 34:
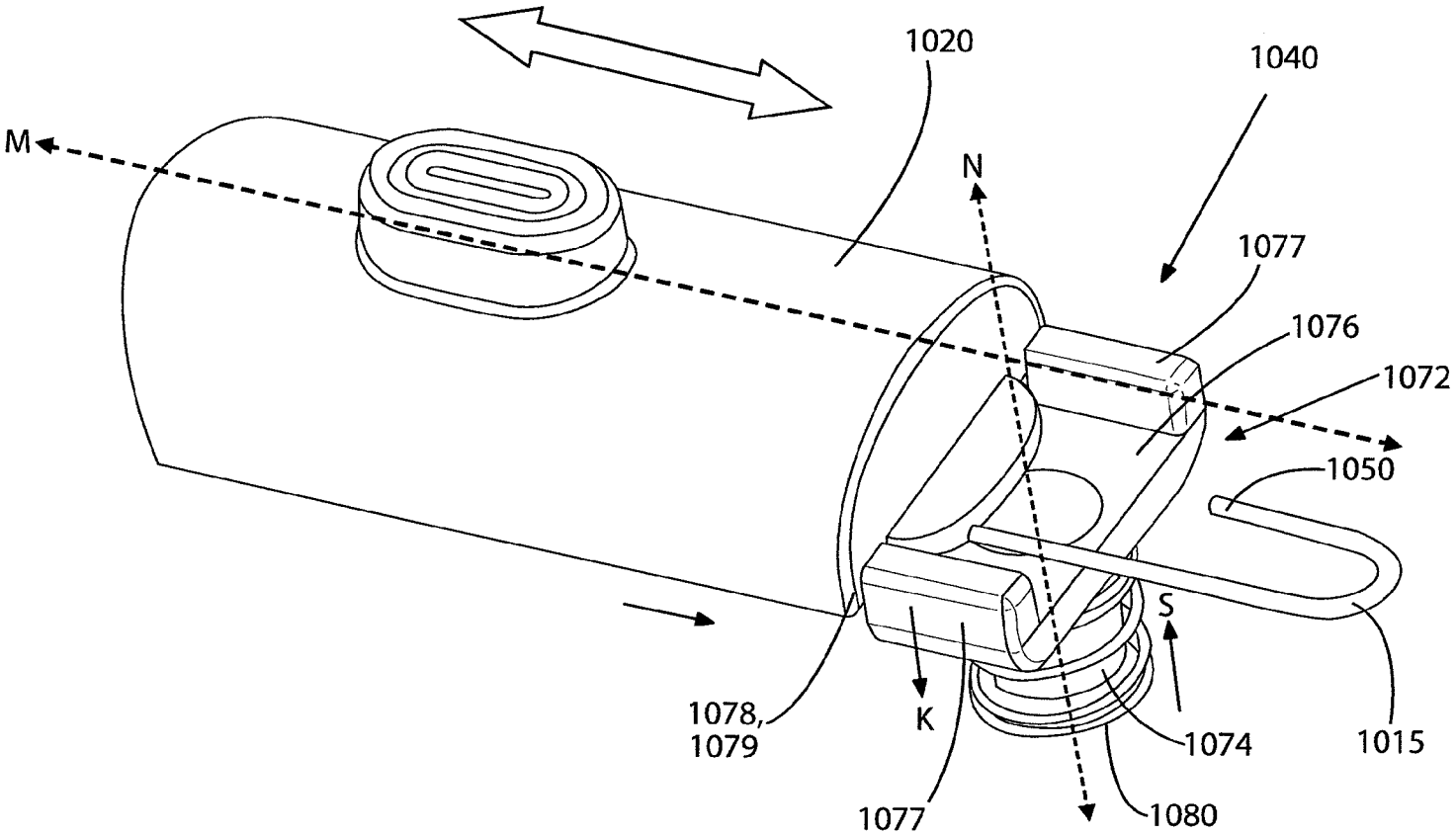
Figure 35:
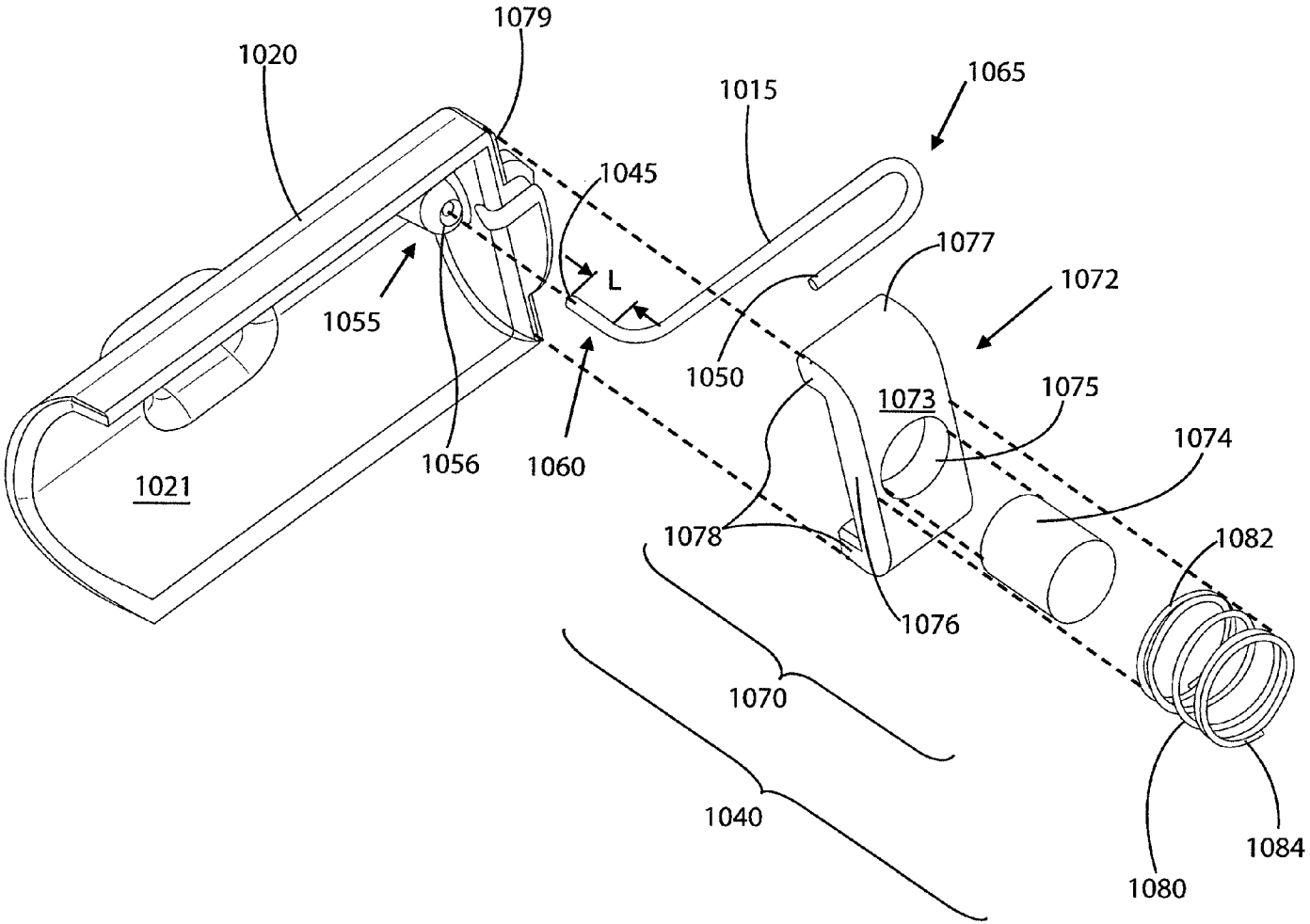
Figure 36:
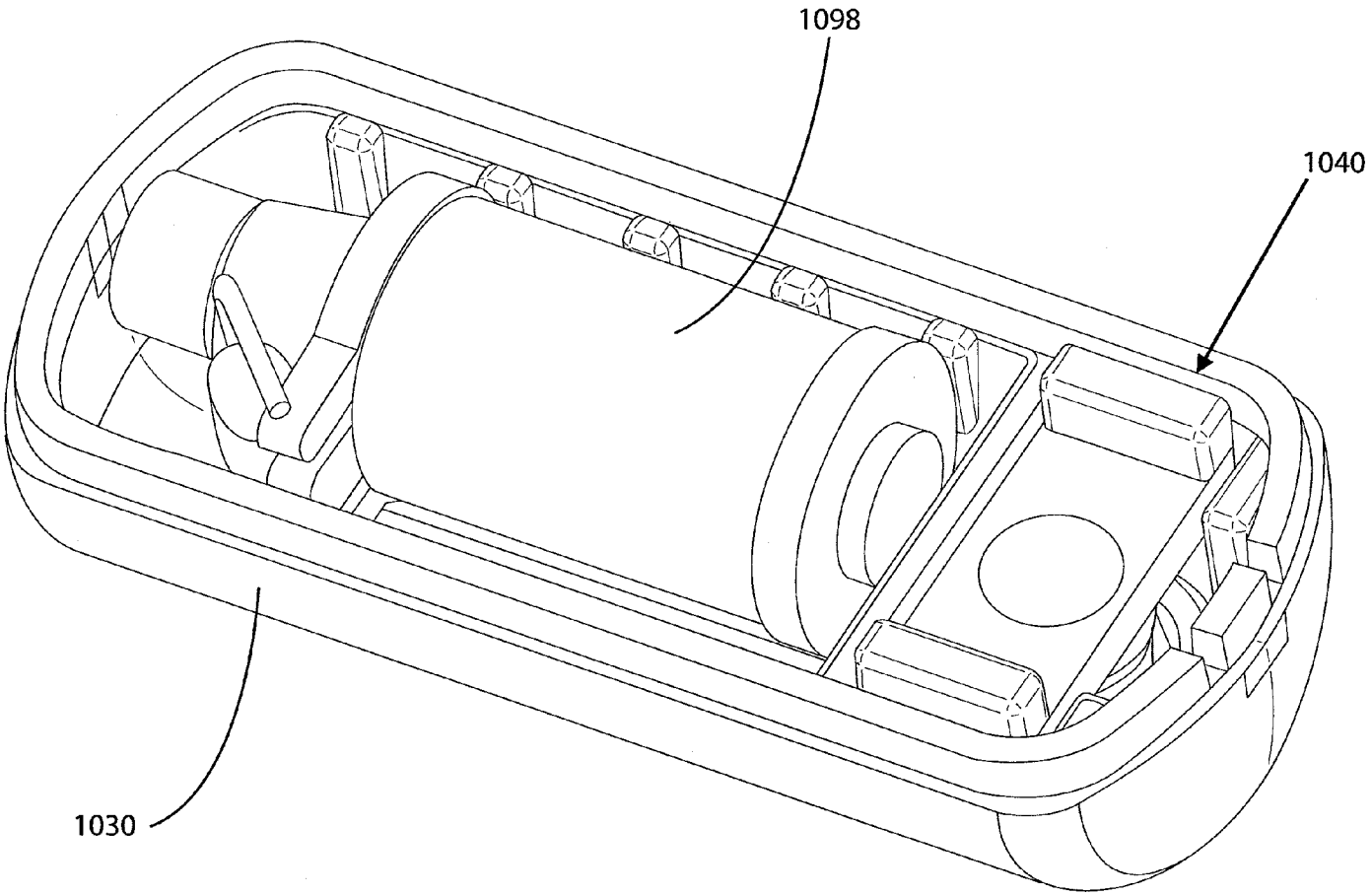

FIG. 12 a bottom perspective view of a first plate of the security device according to an exemplary embodiment of the present invention;

FIG. 13 is a front perspective view of a security device according to another example embodiment of the present invention;

FIG. 14 is a back perspective view of a security device according to an example embodiment of the present invention;

FIG. 15 is a cross-section view of the obscured portion of a security device according to an example embodiment of the present invention;

FIG. 16 is a detail view of a locking assembly for use in security devices according to example embodiments of the present invention;

FIG. 17 is a cut-away view of a security device according to an example embodiment of the present invention;

FIG. 18A is a top plan view of a locking assembly in a locked state according to an example embodiment of the present invention;

FIG. 18B is a top plan view of a locking assembly in an unlocked state according to an example embodiment of the present invention;

FIG. 19 is a perspective view of a security device according to another exemplary embodiment of the present invention;

FIG. 20 is a cross-sectional view of the lock housing of the security device of FIG. 19 according to an exemplary embodiment of the present invention;

FIG. 21 is a cross-sectional view of a locking pin of the security device of FIG. 19 according to an exemplary embodiment of the present invention;

FIG. 22 is a cross-sectional view of the locking pin of the security device of FIG. 21 with a key engaged for unlocking the device;

FIG. 23 is a cross-sectional view of a security device according to another exemplary embodiment of the present invention;

FIG. 24 is a perspective view of a security device according to another exemplary embodiment of the present invention;

FIG. 25 is a top plan view of a security device according to another exemplary embodiment of the present invention;

FIG. 26 is a side view of the security device of FIG. 25;

FIG. 27 is a top plan view of a security device according to another exemplary embodiment of the present invention;

FIG. 28 is a side view of the security device of FIG. 27;

FIG. 29 is a perspective view of a security device according to another exemplary embodiment of the present invention;

FIG. 30 is an illustration of a security device attached to a loose article of jewelry according to another exemplary embodiment of the present invention;

FIG. 31 is a perspective view of a security device in a locked state with a sliding member in the capture position according to an exemplary embodiment;

FIG. 32 is a perspective view of the security device of FIG. 31 in an unlocked state with the sliding member in the open position;

FIG. 33 is a perspective view of the security device of FIG. 31 with a first portion of the housing removed;

FIG. 34 is a perspective view of the sliding member, a locking assembly, and a capture member of the security device of FIG. 31;

FIG. 35 is an exploded view of the sliding member, the locking assembly, and the capture member of the security device of FIG. 34; and FIG. 36 is a perspective view of the security device of FIG. 31 with the first portion of the housing, the sliding member, and the capture member removed.

DETAILED DESCRIPTION

Embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in exemplary embodiments illustrated in the figures.

Some types of cable wrap security devices include a first housing for a ratchet mechanism, a second housing for an security element, and a cable that is routed through both the first and second housings and is configured to wrap around the package of the merchandise. The ratchet mechanism is configured to tighten the cable around the package such that the security device is not removable from the package without being loosened. These security devices may further include a locking feature that prevents loosening or release of the cable without a specifically configured key or other specialized equipment that is controlled by the employees of the retail establishment. In some applications, the cable of these types of cable wrap security devices also prevents a consumer or would-be thief from opening or otherwise tampering with the package to get to the merchandise within the package. Examples of such security devices are described in U.S. Pat. No. 7,497,101 and U.S. Published Application No. 2009/0223260, the contents of both of which are hereby incorporated by reference.

Various prior art security devices are not optimal for attaching to small articles, such as jewelry or other accessories, that are sold loose or are supported on a display card. Necklaces, rings, bracelets, watches, hoop earrings, and other types of jewelry and accessories below a certain monetary value, for example, are often attached to a piece of card stock via ties and displayed on open shelves or racks. Thus, the size of the article, the type of packaging, and the relatively inexpensive nature of the goods make the use of prior art security devices impossible, cumbersome, unattractive, and/or not cost-effective.

Accordingly, embodiments of the present invention provide a security device configured to engage various sizes of display cards and/or secure articles that include a ring-shaped component in a practical and unobtrusive manner. The security device may be configured to be secured to merchandise or other objects and to detect unauthorized removal of the item from the retail premises. In some cases, the security device may also be configured to detect tampering of the security device. Thus, the security device may further include one or more alarm features. Moreover, the security device according to embodiments of the present invention may also provide other features or functionalities that a retail operator may prefer or consider prior to the use or selection of a particular security device over others. For example, while the security device is configured to prevent unauthorized removal, the device may also be configured to provide easy securing to and/or removal from an object by an authorized operator, such as an employee, and may be reusable.

Figure 1:
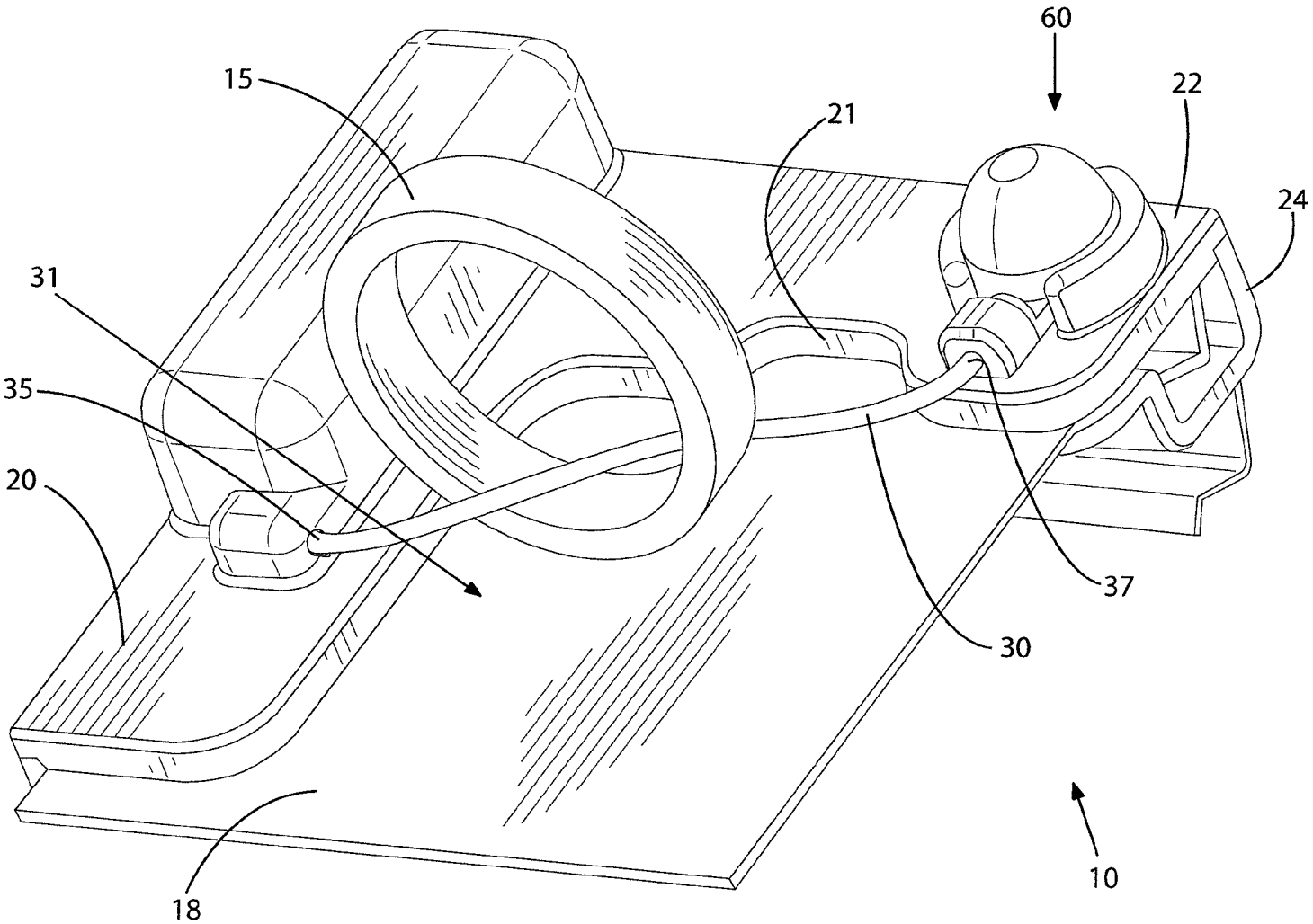
FIG. 1 is a top perspective view of a security device according to an exemplary embodiment of the present invention.
Figure 2:
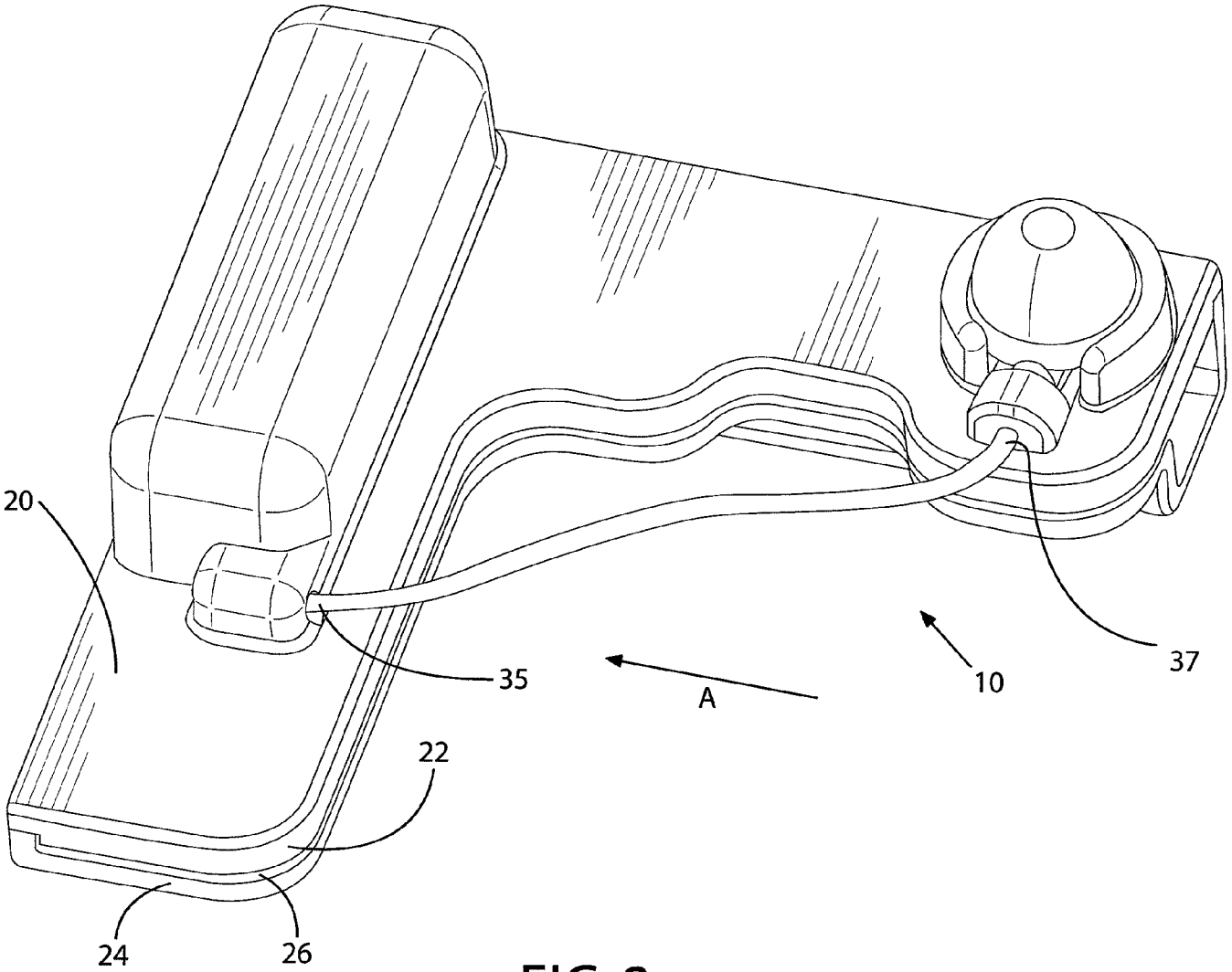
FIG. 2 is a top perspective view of the security device of FIG. 1 without the display card or article.
Figure 3:
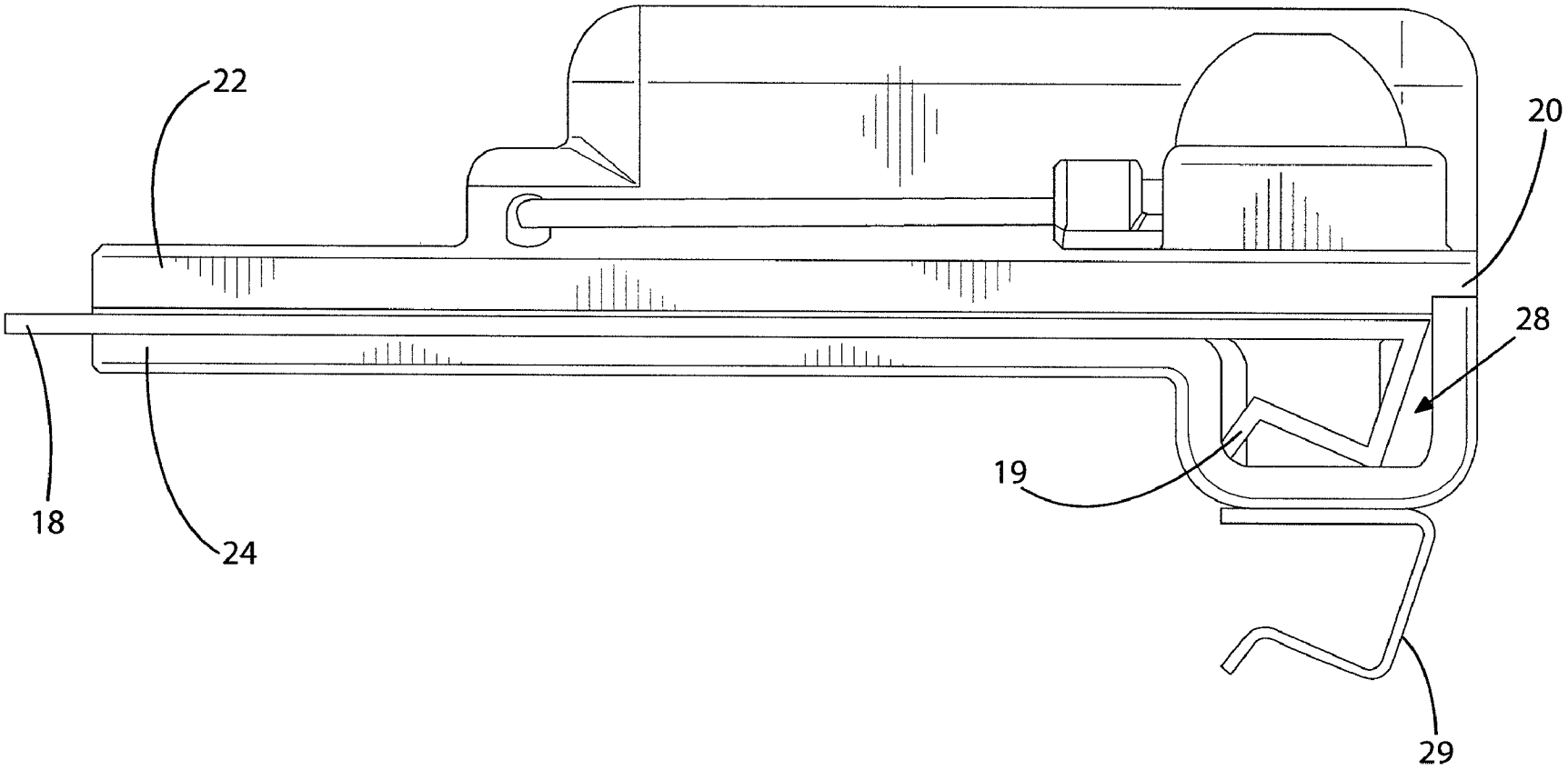
FIG. 3 is a side view of the security device of FIG. 1.

Turning now to the illustrated embodiment of FIGS. 1-12, a security device 10 is shown that includes a main body 20 and a capture member 30. In the depicted example, the security device 10 secures a ring 15, although it is understood that the security device may be used to secure numerous different types of articles. As shown in FIGS. 1, 2, and 3, the main body 20 may be comprised of a first plate 22 and a second plate 24 that are permanently held together, for example by an adhesive or weld. Once the main body 20 is assembled, a gap 26 may be defined between the first and second plates 22, 24 that is configured to receive a display card 18 used for displaying the item 15. For example, a card stock or other type of display card 18 to which an item 15 is attached may be pushed in the direction indicated by the arrow A in FIG. 2 until the display card is fully engaged within the gap 26. In this regard, the first and second plates 22, 24 may be configured such that the resulting gap 26 defines a thickness that is slightly smaller than the thickness of the display card 18, thereby creating a tight, more secure fit between the plates and the display card (e.g., a press fit). In addition, the main body 20 may be configured to define a cavity 28 for receiving a hang tab 19 of the display card 18 normally used for hanging the article on a notched rack. In this regard, the cavity 28 may define a rectangular cross-section and may extend at least partly between two ends of the security device, as shown in FIGS. 1 and 3.

In some embodiments, as shown in FIGS. 1 and 2, for example, the main body 20 is configured to allow the display card 18 carrying the item 15 to be displayed in a number of ways. For example, a cut out portion 21 may be provided that allows access to a hole (not shown) defined in the display card 18 for hanging the article on a pronged display. With reference to FIG. 3, in other cases, a plastic extrusion 29 is adhered or otherwise attached to the main body 20 (e.g., the second plate 24) for allowing the article to be displayed on a notched rack in side-by-side fashion. Returning to FIG. 1, the main body 20 may define a viewing area 31 configured to allow at least a portion of the display card to be viewed by a consumer. For example, the viewing area 31 may be defined by an edge 33 of the first plate 22 that is cut so as to optimize an area of the display card 18 that can be seen when the display card is received by the main body 20, allowing the consumer to see product details, pricing, and/or other information that may be printed on the display card.

Figure 4:
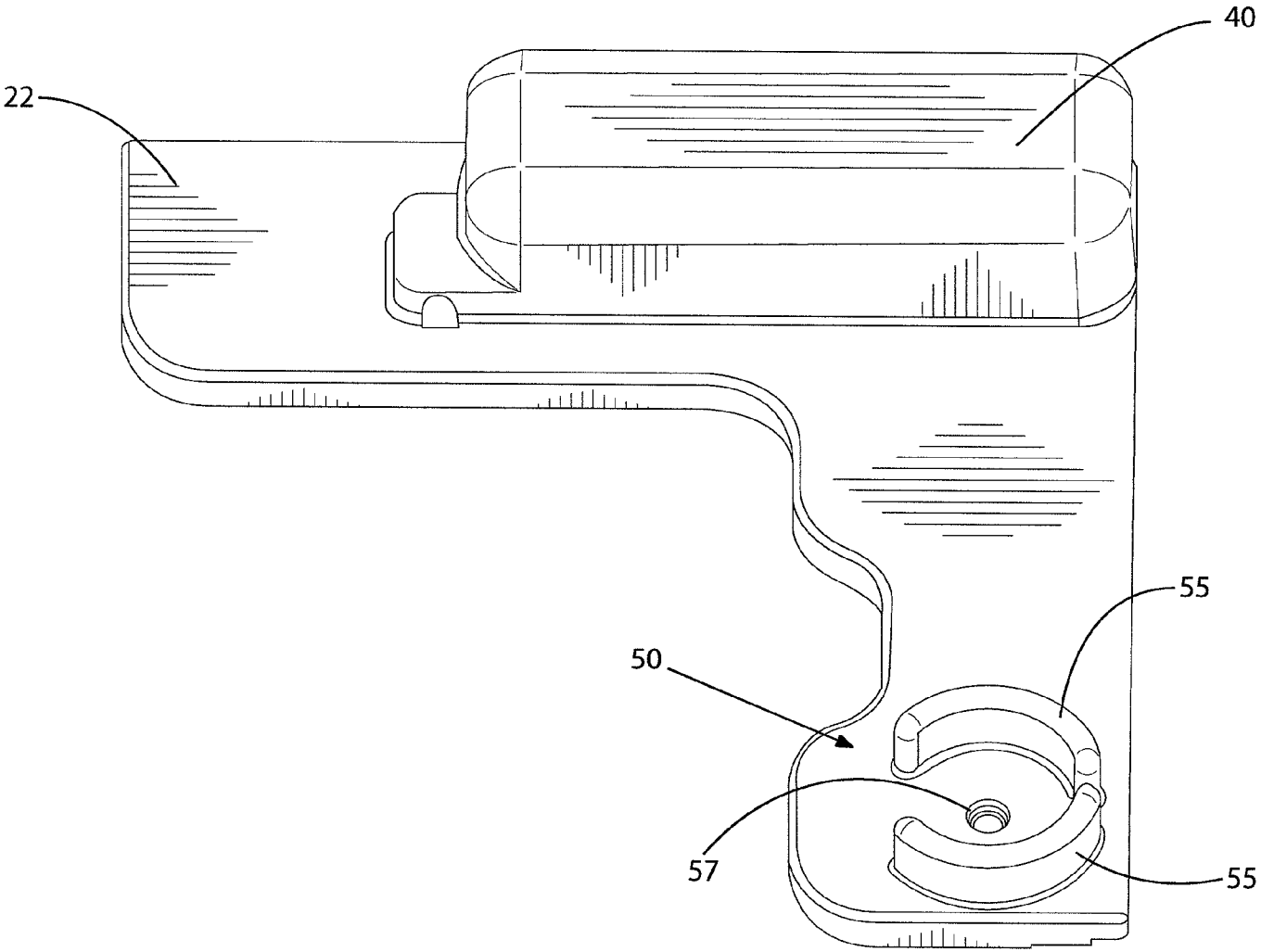
FIG. 4 is a top perspective view of the first plate of the security device according to an exemplary embodiment of the present invention.

Referring now to FIG. 4, the main body 20 may support an alarm housing 40 and a locking area 50. The alarm housing 40 may, for example, be integral to the first plate 22. Similarly, the locking area 50 may be defined by protrusions 55 extending from the first plate 22. In the depicted embodiment, the protrusions 55 are arcuate and define a substantially circular locking area 50. The first plate 22 may further define a recess 57 or other opening for receiving a locking pin 65 (shown in FIG. 7), as described in greater detail below.

Figure 5:
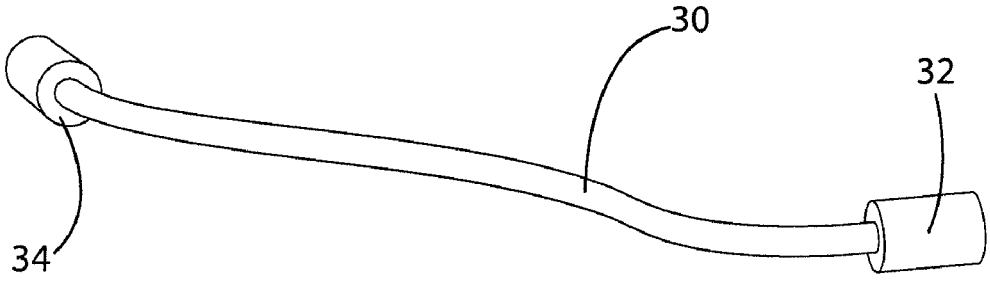
FIG. 5 is a perspective view of the capture member of the security device according to an exemplary embodiment of the present invention.
Figure 6:
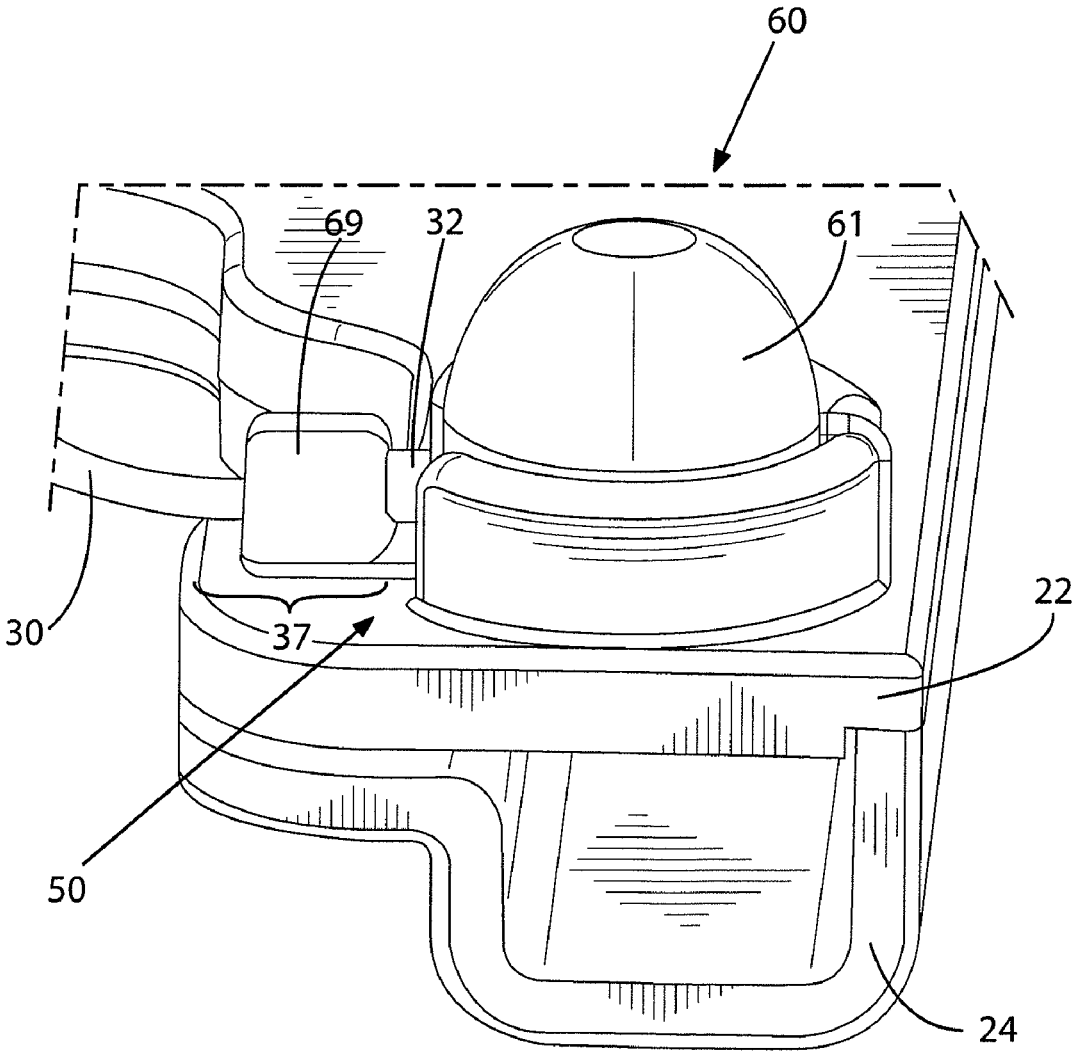
FIG. 6 is a detail perspective view of a locking area of the security device of FIG. 1 according to an exemplary embodiment of the present invention.

The capture member 30 is shown in FIG. 5, and a close-up view of the locking area 50 is shown in FIG. 6. The capture member 30 may be configured in various ways and may be made of different materials suitable for holding the particular article to be secured. For example, in some cases, the capture member 30 may be a flexible cable, such as a galvanized steel cable comprised of seven (7) 7×7 wound cable strands with a diameter of approximately 0.8 mm. The cable in this example may be coated with a polyvinyl chloride (PVC) coating, resulting in an outside diameter of about 1 mm. A ferrule 32, 34 or similar component may be attached to each end of the capture member 30 (e.g., by crimping onto the capture member or using adhesive) to increase the effective diameter at the ends for facilitating the attachment of the capture member to the locking assembly 60 and the alarm housing 40, as follows.

The capture member 30 may define an anchor end 35 and a receiving end 37, shown in FIG. 1. The anchor end 35 may be affixed to the main body 20, and the receiving end 37 may be configured to pass through the ring-shaped component. Moreover, the receiving end 37 may be movable between a capture position, in which the receiving end is engaged with the locking assembly 60 (e.g., as shown in FIG. 1), and an open position, in which the receiving end is disengaged from the locking assembly. In the open position, the receiving end 37 is free to receive an article (e.g., a ring-shaped article).

Figure 7A:
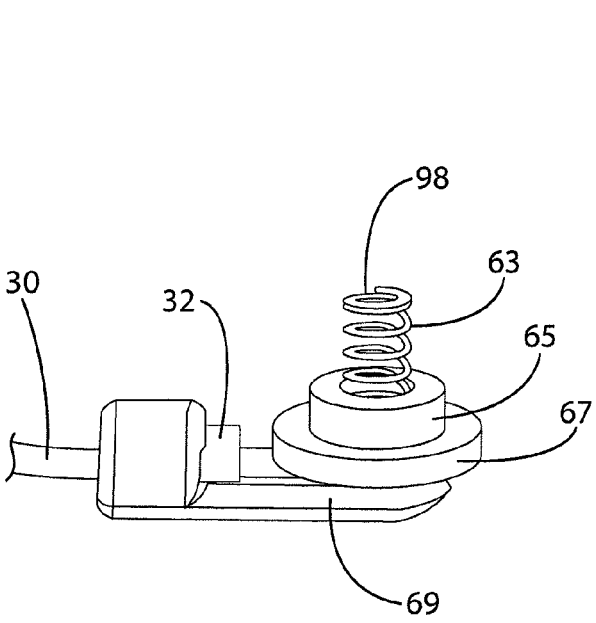
FIG. 7A is a perspective view of the locking assembly of FIG. 7 in an assembled configuration.
Figure 7:
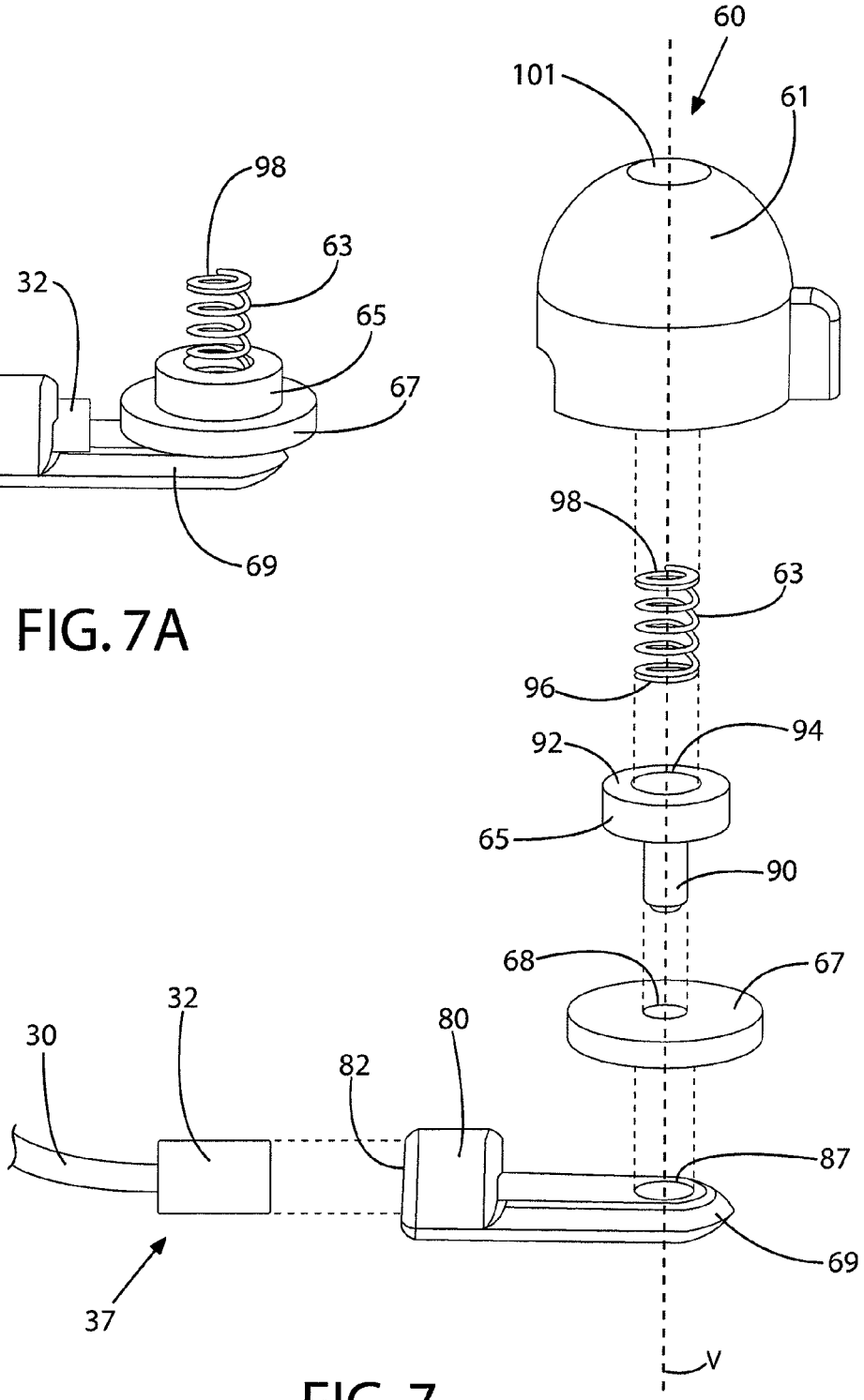
FIG. 7 is an exploded perspective view of the locking assembly of the security device of FIG. 1 according to an exemplary embodiment of the present invention.
Figure 8:
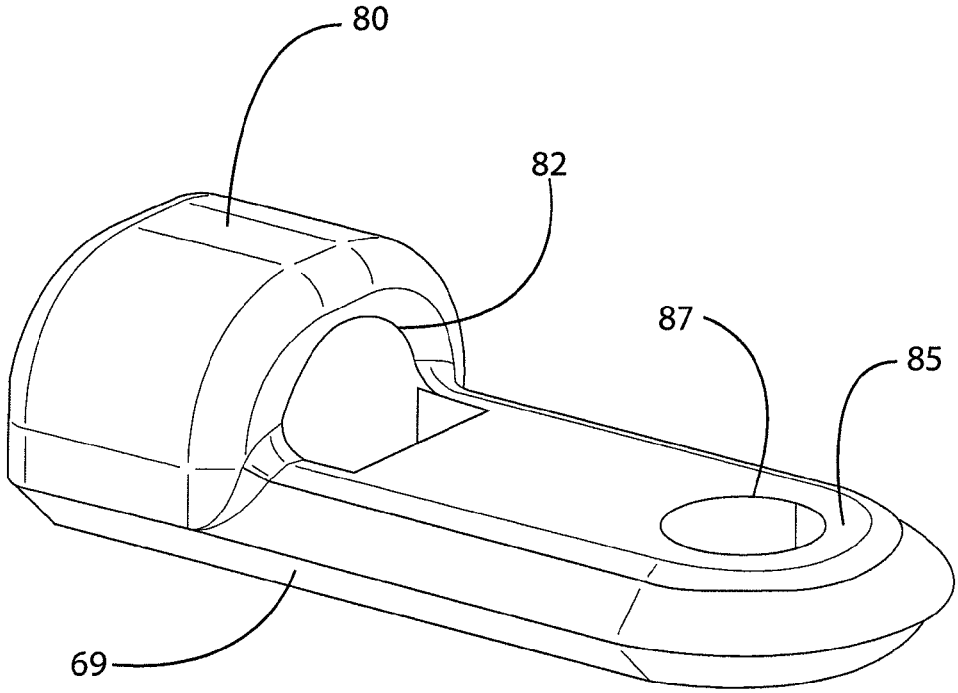
FIG. 8 is a perspective view of a locking clip of the security device of FIG. 1 according to an exemplary embodiment of the present invention.

With reference to FIGS. 6 and 7, the capture member 30 may comprise a locking clip 69 that is configured to engage the locking assembly 60. The locking clip 69, shown in greater detail in FIG. 8, may include a capture member-receiving portion 80 and a pin-receiving portion 85. The capture member-receiving portion 80 may define a first opening 82 configured to receive and secure, for example, the ferrule 32 of the capture member 30. The ferrule 32 may be secured to the locking clip 69 via adhesive, an interference fit, or other method of attachment such that the capture member 30 cannot be pulled free of the locking clip 69.

With reference to FIGS. 7 and 7A, the locking assembly 60 may include a cover 61, a locking spring 63, a locking pin 65, and a locking disk 67. The locking pin 65 may have a shaft 90 and a head 92. The shaft 90 may define a longitudinal axis V and may be configured to engage the pin-receiving portion 85 of the locking clip 69. For example, the pin-receiving portion 85 of the locking clip 69 may define a second opening 87 configured to receive the shaft 90 of the locking pin 65. Referring to FIGS. 4 and 7, the second opening 87 may be substantially aligned with the recess 57 of the first plate 22, such that the shaft 90 of the locking pin 65 may engage both the locking clip 69 and the first plate, thereby fixing the position of the locking clip with respect to the first plate. Consequently, when the locking assembly 60 is engaged with the locking clip 69 and capture member 30 (FIGS. 6 and 7A), the capture member is securely held in place, and the article 15 around which the capture member extends cannot be removed from the security device 10 (see FIG. 1).

As shown in FIG. 7, the locking disk 67 may be configured to rest on the pin-receiving portion 85 of the locking clip 69. The locking disk 67 may define a void 68, which is substantially aligned with the pin-receiving portion 85 (e.g., second opening 87) of the locking clip 69 and the recess 57 of the first plate 22. The void 68 may be configured to receive the shaft 90 of the locking pin 65 therethrough. The locking disk 67 may be attached to the cover 61, such as by ultrasonically welding the circumference of the locking disk to the inner surface of the cover or otherwise adhering or fixing the two components to each other. In this way, the locking disk 67 may limit movement of the locking pin 65 in a direction other than along the longitudinal axis V of the shaft 90.

Figure 9:
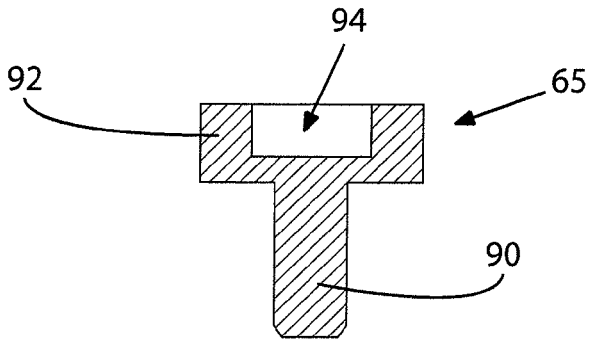
FIG. 9 is a cross-sectional view of the locking pin of FIG. 7.
Figure 10:
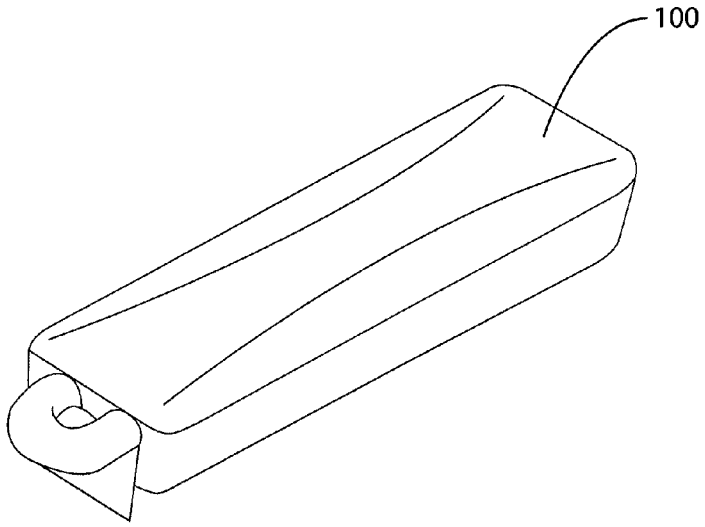
FIG. 10 is a perspective view of a specifically configured key according to an exemplary embodiment of the present invention.

Turning to FIGS. 7 and 9, the head 92 of the locking pin 65 may define a cavity 94 configured to receive the locking spring 63 therein. As noted above, the shaft 90 may be configured to pass through the void 68 defined by the locking disk 67, such that the shaft may be received by the second opening 87 of the locking clip 69 and the recess 57 of the first plate 22 to hold the capture member 30 securely in place. The head 92 of the locking pin 65 may thus be larger than the size of the void 68 of the locking disk 67, such that a surface of the head rests on a corresponding surface of the locking disk and does not allow the locking pin to pass through the locking disk.

As noted above, the locking spring 63 may be configured to sit within the cavity 94 of the locking pin 65. Thus, a first end 96 of the locking spring 63 may engage the head 92 of the locking pin 65, whereas a second end 98 of the locking spring may engage an inner surface of the cover 61 when the locking assembly 60 is assembled. In this way, the locking spring 63 can exert a force on the locking pin 65 to encourage the locking pin to remain engaged with both the locking clip 69 and the first plate 22, thereby holding the capture member 30 in a locked position. Accordingly, in the locked state, the locking spring 63 exerts a force upon the head 92 of the locking pin 65, and, when the capture member 30 is in the capture position, the locking pin is able to maintain engagement of the shaft 90 of the locking pin with the pin-receiving portion 85 of the locking clip 69 to secure the capture member within the locking assembly 60. Thus, in the locked state, the locking assembly 60 is able to engage the receiving end 37 of the capture member 30 to retain the receiving end in the capture position. The locking clip 69, locking disk 67, locking pin 65, and locking spring 63 (without the cover 61) are shown in an assembled and engaged configuration in FIG. 7A.

When an authorized user desires to disengage the locking assembly 60 and unlock the security device 10 (for example, when a customer has paid for the merchandise), the user can urge the locking pin 65 out of engagement with the recess 57 of the first plate 22 and the second opening 87 of the locking clip 69, for example, by applying a magnetic key 100 (shown in FIG. 10) proximate a key-engaging portion 101 of the outer surface of the cover 61. In this regard, at least a portion of the locking pin 65 may be made of a magnetic material, such that application of the key 100 attracts the locking pin towards the cover 61 and pulls it out of engagement. Once disengaged from the shaft 90 of the locking pin 65, the capture member 30 (and the attached the locking clip 69) may be pulled out of the locking assembly 60, thereby allowing the capture member to be moved from the capture position to the open position, and the item 15 may be removed from the security device 10. Thus, in the unlocked state, the locking assembly 60 is disengaged from the receiving end 37 of the capture member 30 to facilitate movement of the receiving end to the open position. One skilled in the art in light of this disclosure will recognize that the magnetic strength of the key may depend on the stiffness of the locking spring 63 chosen.

Referring again to FIG. 4 and as noted above, the first plate 22 may define an alarm housing 40 within which components may reside for providing one-alarm, two-alarm, or three-alarm capabilities to the security device. In the depicted embodiment, for example, the security device 10 has one-alarm functionality, such that an alarm is provided if the engaged security device is passed through a gate (e.g., alerting the owners of a retail establishment that an unauthorized person is attempting to remove the article from the premises).

Figure 11:
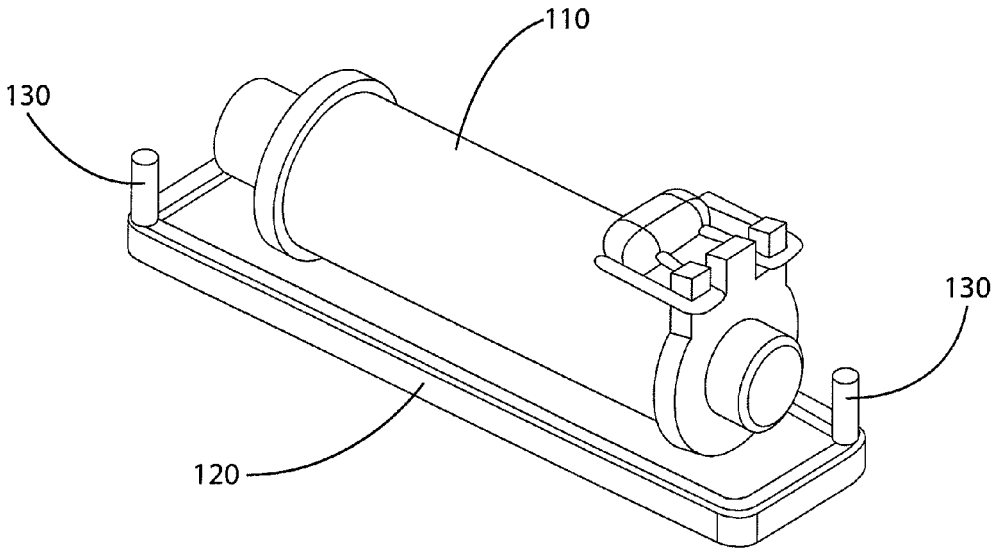
FIG. 11 is a perspective view of a security element of a security device according to an exemplary embodiment of the present invention.

In this regard, turning to FIG. 11, the security device 10 may include a security element 110 within the alarm housing 40 that is configured for providing two- or three-alarm functionality. The security element 110 may be one of any number of devices that is configured to be detected by a security system such as an RFID transponder (e.g., an active tag, a passive tag, etc.) or an Electronic Article Surveillance (EAS) element. In the case of an RFID transponder, a memory component attached thereto may be used to store and/or communicate information about an associated retail product for security or inventory control purposes.

Considering the example of an EAS element, depicted in the figures, the EAS element may be configured to be detectable when the EAS element is present in a predetermined detection zone, such as a zone set up at or near the door or other entrance point of a warehouse or distribution center. The EAS element may be configured to work within an EAS security system. For example, the EAS element may include a magnetic tag, such as those used in an electromagnetic (EM) system or in an acousto-magnetic (AM) system. As another example, the EAS element may be configured work within a microwave system.

Although the depicted embodiment shows a security device configured for one-alarm functionality, in other embodiments (not shown) further components may be included for providing two- or three-alarm functionality. Such components may include a printed circuit board that includes electrical circuitry for supporting various functions of the security device. For example, the electrical circuitry may be connected to a sense loop associated with the capture member 30 such that any discontinuity (e.g., cutting of the capture member) in the sense loop is recognized as a fault condition, which triggers alarm functionality, such as the sounding of a piezoelectric speaker or the lighting of an LED. Therefore, in some embodiments, the security device 10 may have three alarm features: (1) the gates themselves alarming when the security element 110 is detected; (2) the audible alarm (e.g., a piezoelectric speaker) of the security device itself triggering when the capture member 30 is compromised or otherwise tampered with; and (3) the audible alarm (e.g., a piezoelectric speaker) of the security device triggering when the security element is at, near, or beyond the security gates.

Referring again to FIG. 11, the security element 110 may be welded to a carrier plate 120, as shown, and the carrier plate may include one or more extensions 130 configured to engage corresponding receiving features 140 in the alarm housing 40, as shown in FIG. 12. In this way, the carrier plate 120 and the alarm housing 40 may cooperate to contain the alarming components (such as the security element 110) such that the alarm components cannot be removed from the security device 10.

Embodiments of a security device 10 have been described above with respect to FIGS. 1-12 in which a card stock or display card holding the item to be secured is received between first and second plates of the main body of the security device. FIGS. 13-18B illustrate another embodiment of a security device 800 configured to attach to a display card 810 and secure an article 820 thereto. The depicted embodiment includes a main body 802 comprising a display portion 804 and an obscured portion 806. The display card 810 is secured via a gap 809 defined between the display portion 804 and the obscured portion 806 as the display card 810 is inserted into the gap 809 along arrow B. The main body 802 may define a cavity 808 configured to receive the hang tab 812 of the display card 810. A capture member 840 is configured to extend from a first location 842 on the security device 800, through the article to be secured 820, and terminate in a second location 844 on the security device 800. The article to be secured 820 is thereby retained by the capture member 840 between the first location 842 and the second location 844, as described above with respect to FIGS. 1-12.

The illustrated embodiment depicts a substantially flat display portion 804 that may be made of a translucent or transparent material, such as polycarbonate, to provide an aesthetically pleasing appearance by minimizing obstruction of the display card 810, which may include writing, price information, artwork, or the like. Such an embodiment may minimize the visibility of the security device when the display card 810 and article to be secured 820 are viewed from the front, thereby not detracting from the article's appearance and potentially increasing a consumer's likelihood of purchase.

FIG. 14 illustrates the embodiment of FIG. 13 as shown from behind. As illustrated, the security device 800 includes an obscured portion 806 (e.g., a portion of the security device that is obscured by the display card 810 when viewed from the front) disposed opposite the display portion 804. The gap 809 may thus be defined between the display portion 804 and the obscured portion 806. The security device 800 may further comprise an extrusion 860 (shown in FIG. 14) extending from the obscured portion 806 and configured to engage a notched display rack (not shown) for displaying the article 820 while secured by the security device.

The main body 802 may support an alarm housing 850. The alarm housing 850 may enclose a security element, such as the EAS element of FIG. 11. The obscured portion 806 of the main body 802 may be made of a transparent, translucent, or opaque material. A transparent material may be desirable if a retailer wishes for the security element to be clearly visible to a would-be thief to enhance the theft-deterrent effects of the security device 800. A translucent material may be desirable for the same reasons and may further conceal the locking assembly, which is described below. An opaque material may be desirable for aesthetic appearance, and optionally the obscured portion 806 may be brightly colored to clearly indicate to a would-be thief that the article to be secured 820 is fastened to an anti-theft device.

FIG. 15 illustrates a cross-section of a security device according to the embodiment illustrated in FIGS. 13 and 14 as taken along a plane parallel with the display card 810. The illustrated cross-section depicts the obscured portion 806 of the security device 800 comprising a cavity 808 wherein the hang tab 812 of the display card 810 is inserted and a cavity 852 of the alarm housing 850 in which the security element 855 is housed. Further included proximate the alarm housing 850 is the first location 842 from which the capture member 840 extends. The anchor end 846 of the capture member 840 may be permanently encapsulated by the obscured portion 806 of the security device 800. The anchor end 846 may include a crimp nut or similar terminal element to retain the anchor end 846 within the cavity 852 or a separate cavity disposed nearby. The receiving end 848 of the capture member 840 is shown in the capture position, engaged with the locking assembly 900 at the second location 844 of the main body 802.

With reference to FIGS. 14 and 15, the main body 802 may support a lock housing 803 that is defined by the obscured portion 806. For example, the lock housing 803 may extend from the obscured portion 806 in a direction away from the display portion 804, as shown. The lock housing 850 may thus be at least partially disposed between the extrusion 860 and the gap 809 within which the display card 810 is received. In this regard, the display portion 804 of the main body 802 may include an access port 845 (shown in FIG. 13) configured to provide access for the receiving end 848 of the capture member 840 to pass through the main body and engage the locking assembly.

FIG. 16 illustrates a locking assembly that may be used in conjunction with embodiments of the present invention, such as with the embodiments of the security device 800 of FIGS. 13-15. As illustrated in FIGS. 13-15, the receiving end 848 of the capture member 840 may engage the locking assembly 900 via the access port 845 at the second location 844. The receiving end 848 of the capture member 840 may include a tip 906 and a recess 904. The locking assembly 900 may include a locking member 910 and a biasing element 920 configured to bias the locking member 910 in the direction of arrow C. When the receiving end 848 of the capture member 840 is inserted into the lock housing 803 at the second location 844 and pressed in the direction of arrow D, the tip 906 of the receiving end 848 drives the locking member 910 against the biasing element 920 as it is pressed past the locking member 910. Once the tip 906 is past the locking member 910, the biasing element 920 presses the locking member 910 into engagement with the recess 904. The locking member 910 may thus define a recess that corresponds to the recess 904 of the receiving end 848 of the capture member 840. Once the locking member 910 is engaged with the recess 904, the receiving end 848 of the capture member 840 cannot be removed from the lock housing 803, i.e., in a direction opposite arrow D.

FIG. 17 illustrates a cut-away view of the lock housing 803 showing the locking member 910 in engagement with the recess 904 of the receiving end 848 of the capture member 840. FIG. 17 further illustrates detents 940 defined on a surface of the main body 802 that are configured to accept corresponding tabs from a key (not shown). The key may include a magnet that is located proximate the locking assembly 900 when the tabs of the key are aligned with detents 940. In this regard, at least a portion of the locking member 910 may be made of a magnetically attractive material such that the magnet of the key draws the locking member 910 in a direction opposite arrow C of FIG. 16 to disengage the locking member 910 from the recess 904 of the receiving end 848 of the capture member 840. Once the locking member 910 is disengaged from the recess 904, the receiving end 848 of the capture member 840 is movable from the capture position to the open position. FIG. 18A illustrates the locking member 910 in engagement with the recess 904 of the receiving end 848 of the capture member 840, whereby the locking assembly 900 defines a locked state. FIG. 18B illustrates the locking member 910 disengaged from the recess 904 of the receiving end 848 of the capture member 840, whereby the locking assembly 900 defines an unlocked state. FIG. 18B further illustrates the biasing element 920, in this case a coil spring, in the retracted, compressed position.

As shown in FIGS. 17, 18A, and 18B, the locking member 910 may further define a recess 912, which may be a through-hole or a cavity. The recess 912 may be configured to receive a corresponding tab (not shown) when the locking member 910 is in the locked state. The tab may be of a hemispherical profile or similar and extend from a location fixed within the lock housing 803 (e.g., an interior surface of the lock housing) to engage the recess 912 of the locking member 910 when the locking member 910 is in the locked state. The tab may retain the locking member 910 in the locked state during unintended movement of the security device (e.g., when the security device is dropped or abruptly jarred) when a key is not applied. The rounded profile of the tab may resist movement of the locking member 910 away from the locked position; however, the rounded profile of the tab enables the locking member 910 to be retraced to the unlocked position when a key is applied, the force applied by the key being sufficient to overcome the force exerted by the tab. When the tab is engaged with the recess 912, the tab may provide further robustness of the security device against tampering.

Embodiments of a security device 10 have been described above with respect to FIGS. 1-18B in which a display card holding the item to be secured is received within a gap defined by the main body of the security device. Thus, the capture member is configured to engage and secure the ring-shaped component, and the main body is configured to engage and secure the display card via the gap.

In other embodiments, the security device may be configured to secure the item regardless of the presence of a display card. With reference to FIGS. 19-22, a security device 200 is provided that includes an alarm housing 210, a lock housing 220, and a capture member 230 (such as a cable) extending between the two housings. The alarm housing 210 and the lock housing 220 may be integral to each other, or they may be fixedly attached to one another such that the two housings cannot be separated from each other. The alarm housing 210 may be configured to hold various alarm components, including an security element, as described above with respect to the embodiments of FIGS. 1-12.

Turning to FIG. 20, which shows a cross-section of the lock housing 220, the lock housing may be configured to receive and engage a locking pin 240, which may be fixedly attached to one end of the capture member 230 (for example, via a ferrule 232). In this regard, the locking pin 240, shown separate from the lock housing 220 in FIG. 21, may include one or more locking arms 242 that define one or more locking extensions 244.

The lock housing 220, which may be cylindrical, as illustrated, may define an exterior wall 202 and an interior wall 204, and the interior wall may define at least one locking feature 250, such as a ridge or a notch, that is configured to engage a corresponding locking extension 244 of the locking pin 240. The lock housing 220 may further define at least one channel 206 and an interior cavity 208. Each channel 206 may be disposed between the exterior wall 202 and the interior wall 204, and each notch of a locking feature 250 may extend between a channel 206 and the interior cavity 208. One end of the lock housing 220 may define a pin-receiving opening 212 in communication with the channels 206, and each channel may be configured to receive a corresponding locking arm 242 via the pin-receiving opening such that a surface of the at least one locking extension engages the at least one locking feature to secure the locking pin within the lock housing in a capture position. In this regard, the locking pin 240 and/or the locking arms 242 may be made of a material that has some degree of flexibility to allow the locking extensions 244 to be moved past and clear of the locking features 250 of the lock housing 220 when the locking pin is being inserted into the lock housing in the direction of the arrow E to engage the lock and secure the item.

To facilitate the insertion of the locking pin 240, the locking extensions 244 may be tapered, for example, as depicted in FIGS. 20 and 21, such that the movement of the locking arms 242 past the locking features 250 urges the locking arms away from each other to clear the locking features when the locking pin is moved from the open position to the capture position.

Once the locking pin 240 is engaged in the lock housing 220, as shown in FIG. 20, a surface of the locking extensions 244 engages the locking features 250 of the lock housing such that the locking pin cannot be withdrawn from the lock housing, thereby securing the item to the security device. An authorized user may thus only disengage the security device to be able to withdraw the locking pin 240 and release the item by using a specially configured key 260.

The key 260 may include a shaft 262 and a body 264, and the shaft may define one or more cam features 265 corresponding to the number of locking extensions 244 of the locking pin 240 at locations along the shaft corresponding to the locations of the locking extensions. The key 260 may be inserted into a key-receiving opening 270 defined by the lock housing 220, which is in communication with the interior cavity 208 and is disposed opposite the pin-receiving opening 204. The key 260 may be inserted in the direction indicated by the arrow F until a surface 268 of the key 260 engages the key-receiving opening 270 of the lock housing, as shown in FIG. 22. Due to the configuration of the cam features 265 of the key 260, the lock housing 220 may be configured to receive the key within the interior cavity 208 in a predetermined orientation via the key-receiving opening 270 such that the key can only be inserted into the lock housing 220 in a limited number of orientations (for example, with the widest dimension of the cam features aligned in an axis perpendicular to the axis of the locking features 250 so as to clear the locking features). Once the key 260 is inserted into the lock housing 250 and the cam features 265 are aligned with the locking extensions 244 of the locking pin 240, the key may be rotated within the interior cavity 208 as shown by the arrow G such that the cam features engage the corresponding locking extensions and move the locking arms 242 away from the central axis of the key, disengaging the locking extensions 244 from the corresponding locking features 250 of the lock housing 220, as shown by the arrows H. With the locking arms 242 in this position, the authorized user may then withdraw the locking pin 240 from inside the lock housing 220 without interference from the locking features 250, thereby moving the locking pin from the capture position to the open position and allowing the secured item to be released from the capture member 230.

As the key 260 functions to unlock the locking pin 240 from the lock housing 220 in a mechanical manner rather than by using magnetic force, the locking pin need not be made of a material with magnetic properties. For example, the locking pin 240 may be made of plastic or of a non-magnetic metal, such as steel. Embodiments of such security devices 200 may be relatively small in size, such as in the range of 10-15 mm in width (e.g., diameter of the lock housing 220), 20-25 mm in length (e.g., dimension across both the lock housing 220 and the alarm housing 210), and 30-40 mm in height (e.g., height of the alarm housing). As a result, when the capture member 230 is in the open position, the locking pin 240 is capable of being passed through a ring-shaped component for securing an item supporting the ring-shaped component. With respect to small security devices, use of a non-magnetic locking pin 240 may provide the additional benefit of avoiding adverse effects on a security element, such as an EAS element, disposed within the alarm housing, which is in close proximity to the locking pin.

One skilled in the art would appreciate the other improvements and enhancements that the security device, according to embodiments of the present invention, provides over some of the conventional security devices. Many modifications and other embodiments of the inventions set forth herein will come to mind to one skilled in the art to which these inventions pertain having the benefit of the teachings presented in the foregoing descriptions and the associated drawings. For example, FIGS. 23-29 show multiple additional embodiments for securing articles with ring structures or including ring-shaped components.

In FIG. 23, for example, a security device 300 is shown that includes an alarm housing 310, a lock housing 320, and a capture member 330 encapsulated by the alarm housing. The alarm housing 310 may include alarm components, such as a small ferrite 315 or an EAS element described above. The capture member 330 may be attached to a locking clip 340 at an unencapsulated end, and the locking clip may be configured to be received within the lock housing 320 to secure an article (not shown) by looping the capture member around the article. For example, the locking clip 340 may include locking protrusions 350 that may be flexible such that the locking clip may be pushed through an opening 360 of the lock housing 320. Once received within the lock housing 320, however, the locking protrusions 350 may securely engage locking features 370 defined by the lock housing, such that the locking clip 340 may not be withdrawn. In this regard, the security device 300 depicted in FIG. 23 may be a disposable device (e.g., the device may be configured such that it cannot be removed from the article without damaging the device).

In another embodiment, depicted in FIG. 24, a security device 400 may be provided that includes a housing 410 holding alarm components and capturing two ends of a capture member 430. The capture member 430 may be threaded through a display card 18 and looped around the article 15 held onto the display card, thereby securing the article. One end of the capture member 430 may be fixed within the housing 410, and another end 440 may be releasably engaged within the housing 410 via locking features such as those described above. For example, the security device 400 may be a reusable device in that the releasable end 440 of the capture member may unlock from the housing 410 when a magnetic key (such as the key 100 shown in FIG. 10) is applied to an exterior of the housing.

Referring to FIGS. 25 and 26, in another embodiment, a security device 500 is shown that includes a housing 510 that is configured to engage two locking plungers 520 attached to the ends of a capture member 530. As shown in FIG. 26, the plungers 520 may be, for example, pin/ball clutches and may be configured to punch through the display card 18. A shaft 540 of each plunger may be securely received within the housing 510. The article 15, through which the capture member 530 may be looped, may thus be locked to the security device 500. Each plunger 520 may be separately releasable from the housing 510, such as through the use of a magnetic key.

In FIGS. 27 and 28, yet another embodiment of a security device 600 is shown that includes a housing 610 configured to wrap around and hold a display card 18 bearing an article 15. The housing 610 may include a hinge 620 that connects the housing to an article-engaging tongue 640. Thus, the tongue 640 may be configured to have a smaller width than the inner diameter of the article 15, such that the tongue is able to pass through the article. The tongue 640 may, for example, include two rigid portions 650, 655 and one or more cables 630 extending between the rigid portions to allow the tongue to hold the article and card stock securely to the device 600. The unhinged end 660 of the tongue 640 may be configured in a clam shell locking design and may include a locking pin 670 configured to lock the tongue to the housing 610, thereby securing the display card 18 within the housing 610 and holding the article 15 securely to the device 600. In some embodiments, the locking pin 670 may engage the housing 610 via a spring (not shown), and the pin may be disengaged from the housing by applying a magnetic key to the housing proximate the location of the pin. The housing 610 may be configured to include a hang tab 680 for displaying the article 15.

In another embodiment shown in FIG. 29, a security device 700 is depicted that includes a hinged housing 710 configured to hold an article and/or a display card holding the article (not shown) therein. Windows 720 may be provided to allow the article to be viewed and/or to allow the article to extend from within the housing 710 when on display. The unhinged end 730 of the housing 710 may be configured to engage a locking spring 740, where the locking spring is designed to secure the housing 710 in a closed position. The locking spring 740 may in turn be configured to be disengaged through application of a magnetic key to the exterior of the unhinged end 730 of the housing 710, thereby attracting the magnetic tabs of the locking spring from engagement with corresponding features of the unhinged end and allowing the housing to be opened.

In one or more of the embodiments described above, the display card carrying the item to be secured may include a carbon based printed trace that is either incorporated in the display card or on a piece of tape that is looped through the item. An example of such conductive tape is available from MeadWestvaco Corporation. A disruption in the trace and/or the display card in such embodiments would cause a failure in the sense loop and would, as a result, send the security device into alarm mode, as described above.

In still other embodiments, a security device may be provided that is configured to secure items, such as articles of jewelry, clothing accessories, belts, shoes (e.g., through the eyelets provided for laces), bras and undergarments, hats, cookware, and other items incorporating a loop or ring component, regardless of the presence of a display card. For example, as depicted in FIGS. 30-36, a security device 1000 may be provided that is small (e.g., approximately 10-15 mm tall, 12-16 mm wide, and 30-35 mm long) and unobtrusive, such that, when the device is attached to a loose article of jewelry 1005, as shown in FIG. 30, a consumer is still able to view and possibly try on the jewelry to determine whether to purchase the item. At the same time, however, the security device may deter potential shoplifters by providing one-, two-, or three-alarm functionality as described above with respect to other embodiments of the security device.

Turning to FIGS. 31 and 32, the security device 1000 may include a housing 1010 and a capture member 1015 extending partially outside the housing. The capture member 1015 may be permanently affixed to a sliding member 1020 disposed at least partially within the housing 1010, such that moving the sliding member between a capture position (FIG. 31) and an open position (FIG. 32) also moves the capture member, as described in greater detail below.

The housing 1010 may, in some cases, include a first portion 1025 and a second portion 1030 that are configured to fit together to form the housing. For example, the first and second portions 1025, 1030 may be made of plastic and may be adhered or ultrasonically welded at a seam 1035 such that, once assembled, the housing 1010 cannot be taken apart.

FIG. 33 shows the security device 1000 with the first portion 1025 removed for purposes of explanation. As depicted, in addition to the sliding member 1020 and the capture member 1015, the security device 1000 may further include a locking assembly 1040 disposed within the housing 1010. The sliding member 1020 may be configured to move along a first axis M between the capture position and the open position, in the directions shown by the arrow. The locking assembly 1040, in turn, may be configured to engage the sliding member 1020 to limit the axial movement of the sliding member, thereby retaining the sliding member in the capture position when the locking assembly is in a locked state. The locking assembly 1040 may further be configured to disengage from the sliding member to facilitate the axial movement of the sliding member from the capture position (FIG. 31) to the open position (FIG. 32) when the security device is in an unlocked state. In FIG. 33, for example, the locking assembly 1040 is shown engaged with the sliding member 1020, thereby preventing movement of the sliding member and maintaining the sliding member in the capture position.

In FIGS. 34 and 35, the sliding member 1020, the capture member 1015, and the locking assembly 1040 are shown with the housing and other components removed for purposes of explanation. The capture member 1015 may be configured to include an anchor end 1045 (not visible in the assembled view of FIG. 34, but shown in the exploded view of FIG. 35) and a receiving end 1050. The anchor end 1045 may be permanently affixed to the sliding member 1020. For example, the sliding member 1020 may define an internal surface 1021, and the internal surface may define a receiving portion 1055 configured to receive and secure the anchor end 1045 of the capture member 1015. The receiving portion 1055 may include, for example, a recess 1056 having a certain depth configured to receive a corresponding length L of the capture member 1040 proximate the anchor end 1045.

In this regard, the capture member 1015 may define a fixed portion 1060 proximate the anchor end 1045 and a hook portion 1065 proximate the receiving end 1050. The fixed portion 1060 may thus define the length L that is received and held by the recess 1056 of the receiving portion 1055 of the sliding member 1020. The hook portion 1065 may have a "U" shape, as illustrated, such that the receiving end 1050 may be retracted into the housing when the sliding member 1020 is moved to the locked position, as described below. In the depicted embodiment, the hook portion 1065 extends substantially perpendicularly from the fixed portion 1060. In this way, a pulling force applied to the hook portion 1065 of the capture member 1015, such as may occur when a consumer is handling the secured item or when a potential shoplifter is attempting to disengage the security device from the item, would not pull the anchor end 1045 of the capture member out of the receiving portion 1055 of the sliding member 1020. In other words, by virtue of the configuration of the capture member 1015 and the receiving portion 1055, the anchor end 1045 of the capture member may be permanently affixed to the sliding member. In some cases, the anchor end 1045 may, alternatively or in addition, be adhered or otherwise bonded to the receiving portion 1055 of the sliding member 1020.

The receiving end 1050 of the capture member 1015 may be configured to receive a portion of the item to be secured (as depicted in FIG. 30) when the sliding member 1020 is in the open position (i.e., when the receiving end is outside of the housing 1010, as shown in FIG. 32). Thus, when the security device 1000 is in the unlocked state and the sliding member 1020 is in the open position, as shown in FIG. 32, an item, such as the necklace 1005 shown in FIG. 30, may be slipped past the receiving end 1050 and engaged with the hook portion 1065 of the capture member. The receiving end 1050 may further be configured to be received within the housing 1010 to secure the item to the security device when the sliding member 1020 is moved to the capture position (as shown in FIGS. 30 and 31). With the sliding member 1020 in the locked position and the security device in the locked state (e.g., with the locking assembly 1040 engaged with the sliding member), the receiving end 1050 is no longer accessible, and the item is maintained in engagement with the capture member 1015. Thus, whereas the receiving end of the capture member described above with respect to the embodiment illustrated in at least FIGS. 1-22 is configured to engage the locking assembly to secure the item, in the embodiments depicted in FIGS. 30-36 the receiving end is not engaged with the locking assembly, but rather is maintained within the housing 1010 through engagement of the locking assembly with the sliding member to secure the item.

The particular configuration (e.g., shape and dimensions) of the capture member 1015 may be selected such that the particular type of item cannot be removed from the security device 1000 when the security device is locked. For example, in the case of a necklace as illustrated in FIG. 30, the necklace 1005 cannot be unclasped and slipped off the security device 1000 (i.e., via a free end of the necklace) because the beads 1006, in this case, are bigger than the clearance provided by the hook portion 1065 of the capture member 1015. In addition, the material of the capture member 1015 may be selected such that a potential shoplifter cannot easily break or cut through the capture member (e.g., with scissors or nail clippers). For example, in some cases the capture member 1015 may be made of hardened steel wire.

Turning now to FIG. 35, the locking assembly 1040 may comprise a retention member 1070 and a biasing element 1080, such as a spring. The retention member 1070 may define an engagement portion 1072 configured to engage the sliding member 1020 and a shaft portion 1074 configured to be received by the biasing element 1080. The shaft portion 1074 may, for example, be adhered or otherwise attached within an opening or void 1075 of the engagement portion 1072, as depicted, or the shaft portion and the engagement portion alternatively may be formed as one piece.

The biasing element 1080 may be configured to bias the retention member into engagement with the sliding member 1020 to maintain the sliding member in the locked position. For example, the biasing element 1080 may have a first end 1082 that is configured to engage a biasing surface 1073 of the engagement portion 1072 of the retention member 1070 and a second end 1084 that is configured to engage the housing 1010, such as the second portion 1030 of the housing. In the case of a spring, for example, the spring may apply a force on the engagement portion 1072 of the retention member 1070, urging the retention member in the direction S illustrated in FIG. 34.

At least a portion of the retention member 1070 may be magnetic, such that application of a magnetic key (not shown) at a predetermined location on a surface of the housing 1010 may serve to move the retention member out of engagement with the sliding member 1020. Thus, application of the magnetic key may urge the retention member 1070 in the direction K indicated in FIG. 34. By selecting a biasing element 1080 have a particular stiffness, proper engagement of the retention member 1070 with the sliding member 1020 may be achieved to maintain the security device in the locked state, and at the same time the magnetic force applied by the magnetic key may be sufficient to overcome the biasing force, thereby moving the retention member out of engagement with the sliding member to unlock the security device.

With reference to FIG. 34, the sliding member 1020 may be configured to move along a first axis M between a locked position and an unlocked position, as noted above. In some cases, the retention member 1070 may be configured to move into and out of engagement with the sliding member 1020 along a second axis N, where the second axis N is substantially perpendicular to the first axis M, as shown. As depicted in FIGS. 34 and 35, the engagement portion 1072 may comprise a main portion 1076 and end portions 1077, with each end portion extending substantially perpendicularly from the main portion in a direction away from the shaft portion (i.e., in the S direction). The engagement portion 1072 may further define an engagement surface 1078 configured to engage a corresponding surface 1079 of the sliding member 1020. The corresponding surface 1079 of the sliding member 1020 may be defined at an end 1089 of the sliding member, as shown.

The engagement surface 1078, for example, may be defined by the end portions 1077, such that it is the end portions (rather than the main portion 1076) that limit the movement of the sliding member 1020 when the retention member 1070 is engaged with the sliding member. In this way, the main portion 1076 of the engagement portion 1072 does not interfere with the movement of the capture member 1015, which may be positioned adjacent the main portion, as shown in FIG. 34. Thus, movement of the retention member 1070 in the direction K need only move the retention member to the extent that the sliding member 1020 can clear the end portions 1077.

Referring again to FIGS. 31 and 32, the housing 1010 may define a slot 1090, e.g., in the first portion 1025 of the housing. The sliding member 1020 may in turn define an actuation portion 1095 that extends partially through the slot 1090 and is thus accessible to a user via the slot. The actuation portion 1095 may be configured to allow a user to move the sliding member 1020 from the capture position (FIG. 31) to the open position (FIG. 32) when the security device 1000 is in the unlocked state. Thus, a user may remove the security device 1000 from an item (for example, upon its purchase by a consumer) by applying a magnetic key to the housing to disengage the locking assembly 1040 from the sliding member 1020 (see FIG. 34), then moving the actuation portion 1095 from the capture position (FIG. 31) to the open position (FIG. 32) and removing the item from the hook portion 1065 of the capture member 1015 via the receiving end 1050.

As noted above with respect to other embodiments of the security device, and with reference to FIG. 36, the security device 1000 may further include a security element 1098 disposed within the housing. In FIG. 36, in which the first portion 1025 of the housing 1010 and the sliding member 1020 are removed for purposes of explanation, the security element 1098 is disposed in the second portion 1030 of the housing. Thus, as described above, the security device may be configured to provide one-alarm, two-alarm, or three-alarm functionality. In some embodiments, for example, the security element may be a small AM or RF ferrite element to allow for one-alarm functionality.

It is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A security device for securing an item comprising a ring shape, the security device comprising:

a housing;

a sliding member at least partially disposed within the housing and configured to move between a capture position and an open position;

a capture member defining an anchor end and a receiving end, wherein the anchor end is affixed to the sliding member and the receiving end is configured to receive the item when the sliding member is in the open position and to be received within the housing to secure the item to the security device when the sliding member is in the capture position; and a locking assembly disposed within the housing configured to engage the sliding member to limit the movement of the sliding member, wherein the locking assembly is configurable between a locked state, in which the locking assembly engages the sliding member to retain the sliding member in the capture position, and an unlocked state, in which the locking assembly is disengaged from the sliding member to facilitate movement of the sliding member to the open position, wherein the locking assembly comprises a retention member and a biasing element, wherein the retention member defines an engagement portion configured to engage the sliding member and a shaft portion configured to be received by the biasing element, wherein the biasing element is configured to bias the retention member toward engagement with the sliding member to maintain the sliding member in the capture position, and wherein the engagement portion of the retention member comprises a main portion and end portions, wherein each end portion extends substantially perpendicularly from the main portion in a direction away from the shaft portion.

2. The security device of claim 1, wherein at least a portion of the retention member is magnetic, and wherein application of a magnetic key at a predetermined location on a surface of the housing serves to move the retention member out of engagement with the sliding member.

3. The security device of claim 1, wherein the sliding member is configured to move between the capture position and the open position along a first axis, and wherein the retention member is configured to move into and out of engagement with the sliding member along a second axis, wherein the second axis is substantially perpendicular to the first axis.

4. The security device of claim 1, wherein the engagement portion of the retention member defines an engagement surface configured to engage a corresponding surface of the sliding member.

5. The security device of claim 4, wherein the corresponding surface of the sliding member is defined at an end of the sliding member.

6. The security device of claim 1, wherein the housing defines a slot, and wherein the sliding member defines an actuation portion accessible via the slot and configured to allow a user to move the sliding member between the capture position and the open position when the security device is in the unlocked state.

7. The security device of claim 1, wherein the sliding member defines an internal surface, wherein the internal surface defines an anchor portion configured to receive and secure the anchor end of the capture member.

8. The security device of claim 1, wherein the capture member defines a fixed portion proximate the anchor end and a hook portion proximate the receiving end, wherein the hook portion defines a "U" shape.

9. The security device of claim 8, wherein the hook portion extends substantially perpendicularly from the fixed portion.

10. The security device of claim 1, wherein the capture member comprises hardened steel wire.

11. The security device of claim 1 further comprising a security element disposed within the housing.

12. A security device for securing an item comprising:

a housing defining a slot extending along a first axis;

a capture member configured to move along the first axis and defining an anchor end maintained within the housing and a receiving end configured to move between an outside position relative to the housing and an inside position relative to the housing based on movement of the capture member;

a locking assembly configured to move along a second axis substantially perpendicular to the first axis between an unlocked state, in which the capture member is movable along the first axis and the receiving end is movable to the position outside the housing for receiving the item to be secured, and a locked state, in which the receiving end of the capture member is maintained within the housing for securing the received item to the security device, wherein the capture member is movable via the slot when the locking assembly is in the unlocked state;

a sliding member received within the housing, wherein the sliding member defines an internal surface disposed within the housing and an actuation portion extending at least partially through the slot, wherein the anchor end of the capture member is affixed to the sliding member such that the capture member is movable via movement of the actuation portion along the slot when the locking assembly is in the unlocked state; and a security element disposed within the housing, wherein a distance between the internal surface of the sliding member and an opposite internal surface of the housing corresponds to a dimension of the security element disposed therebetween, and wherein the internal surface of the sliding member is disposed adjacent to the security element and has a shape that substantially corresponds to a shape of an opposing surface of the security element.

13. The security device of claim 12, wherein the security element comprises a ferrite element and is configured to provide one-alarm functionality.

14. The security device of claim 12, wherein the housing comprises a first portion and a second portion that are configured to be permanently affixed to each other to form the housing.

15. The security device of claim 12, wherein the locking assembly comprises a retention member and a biasing element, wherein the retention member defines an engagement portion configured to engage the sliding member and a shaft portion configured to be received by the biasing element, wherein the biasing element is configured to bias the retention member toward engagement with the sliding member to limit movement along the first axis of the sliding member and the capture member.

16. The security device of claim 15, wherein at least a portion of the retention member is magnetic, and wherein application of a magnetic key at a predetermined location on a surface of the housing serves to move the retention member out of engagement with the sliding member.

17. The security device of claim 12, wherein the internal surface of the sliding member has a shape that substantially corresponds to a shape of an opposing surface of the security element.

18. The security device of claim 17, wherein the security element and the housing are substantially cylindrical.

19. The security device of claim 12, wherein the housing defines a first end and a second end, wherein one of the first or second ends defines an opening through which the receiving end of the capture member is received when the receiving end is in the inside position, and wherein the slot defined in the first portion extends at least partially between the first and second ends.

20. A security device for securing an item comprising:

a housing defining a slot extending along a first axis;

a capture member configured to move along the first axis and defining an anchor end maintained within the housing and a receiving end configured to move between an outside position relative to the housing and an inside position relative to the housing based on movement of the capture member;

a locking assembly configured to move between an unlocked state, in which the capture member is movable along the first axis and the receiving end is movable to the position outside the housing for receiving the item to be secured, and a locked state, in which the receiving end of the capture member is maintained within the housing for securing the received item to the security device, wherein the capture member is movable via the slot when the locking assembly is in the unlocked state;

a sliding member received within the housing, wherein the sliding member defines an internal surface disposed within the housing and an actuation portion extending at least partially through the slot, wherein the anchor end of the capture member is affixed to the sliding member such that the capture member is movable via movement of the actuation portion along the slot when the locking assembly is in the unlocked state; and a security element disposed within the housing, wherein the internal surface of the sliding member is disposed adjacent to the security element and has a shape that substantially corresponds to a shape of an opposing surface of the security element.

21. The security device of claim 20, wherein the locking assembly comprises a retention member and a biasing element, wherein the retention member defines an engagement portion configured to engage the sliding member and a shaft portion configured to be received by the biasing element, wherein the biasing element is configured to bias the retention member toward engagement with the sliding member to maintain the sliding member in the capture position.

22. The security device of claim 21, wherein the retention member is configured to move into and out of engagement with the sliding member along a second axis, wherein the second axis is substantially perpendicular to the first axis.

23. The security device of claim 20, wherein the security element and the housing are substantially cylindrical.

* * * * *